US012110620B2

(12) United States Patent
Ranzenigo et al.

(10) Patent No.: US 12,110,620 B2
(45) Date of Patent: Oct. 8, 2024

(54) CIRCULAR KNITTING MACHINE AND A METHOD FOR MOVING THE NEEDLES OF A CIRCULAR KNITTING MACHINE

(71) Applicant: SANTONI S.P.A., Brescia (IT)

(72) Inventors: Roberto Ranzenigo, Brescia (IT); Fabio Bonetti, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 330 days.

(21) Appl. No.: 17/617,713

(22) PCT Filed: May 29, 2020

(86) PCT No.: PCT/IB2020/055122
§ 371 (c)(1),
(2) Date: Dec. 9, 2021

(87) PCT Pub. No.: WO2020/250075
PCT Pub. Date: Dec. 17, 2020

(65) Prior Publication Data

US 2022/0235501 A1 Jul. 28, 2022

(30) Foreign Application Priority Data

Jun. 11, 2019 (IT) ..... 102019000008655

(51) Int. Cl.
*D04B 15/32* (2006.01)
*D04B 15/68* (2006.01)

(52) U.S. Cl.
CPC ..... *D04B 15/32* (2013.01); *D04B 15/68* (2013.01)

(58) Field of Classification Search
CPC ..... D04B 15/32; D04B 15/68
(Continued)

(56) References Cited

U.S. PATENT DOCUMENTS 3,411,326 A * 11/1968 Kent ..... D04B 15/32 66/54
3,811,296 A * 5/1974 Bianchi ..... D04B 15/68 66/57

(Continued)

FOREIGN PATENT DOCUMENTS

DE 2944300 A1 * 11/1979 ..... D04B 35/04
DE 102010017951 A1 * 10/2011 ..... D04B 15/68

(Continued)

OTHER PUBLICATIONS

DE-102010017951 Translation (Year: 2023).*

(Continued)

*Primary Examiner* — Danny Worrell
*Assistant Examiner* — Dakota Marin
(74) *Attorney, Agent, or Firm* — MH2 TECHNOLOGY LAW GROUP LLP

(57) ABSTRACT

A circular textile knitting machine includes a drive chain for each needle inserted in a respective longitudinal groove, located below a respective needle and operatively interposed between the respective needle and actuating cams. The drive chain includes a sub-needle arranged below the needle and engaged with the needle to be axially moved in the respective longitudinal groove together with the needle. The sub-needle includes a movable butt radially movable between an operating position, in which it is extracted to be engaged with respective first paths defined by first actuating cams and cause activation of the needle, and a non-operating position, in which it is retracted to not be engaged with the first paths. A selector is partly located below the sub-needle and partly alongside the sub-needle and is configured for oscillating between an active position, in which it pushes the movable butt into the operating position, and a rest position, in which it allows the movable butt to return into the non-operating position. The selector is axially uncoupled from the sub- (Continued)

needle and from the needle in a manner such that the needle and the sub-needle are never pushed or pulled axially by the selector. A selecting device acts upon command on the selectors so as to cause the passage thereof into the active position.

22 Claims, 11 Drawing Sheets

(58) Field of Classification Search
USPC ..... 66/17
See application file for complete search history.

(56) References Cited

U.S. PATENT DOCUMENTS 3,948,063 A * 4/1976 Curtis ..... D04B 15/68 66/219
4,674,301 A * 6/1987 Luchi ..... D04B 35/06 66/13
4,920,767 A * 5/1990 Plath ..... D04B 35/06 66/13
5,035,124 A * 7/1991 Tibbals, Jr. ..... D04B 15/32 66/123
5,077,990 A * 1/1992 Plath ..... D04B 35/28 66/123
5,425,252 A * 6/1995 Lonati ..... D04B 15/78 66/219
5,577,397 A * 11/1996 Lida ..... D04B 15/82 66/123
5,960,645 A * 10/1999 Sangiacomo ..... D04B 15/68 66/13
6,178,786 B1 * 1/2001 Willmer ..... D04B 35/04 66/221
7,207,196 B2 * 4/2007 Lonati ..... D04B 9/36 66/38
7,685,845 B2 * 3/2010 Lonati ..... D04B 15/68 66/216
7,765,834 B2 * 8/2010 Ando ..... D04B 9/10 66/14
11,225,736 B2 * 1/2022 Lonati ..... D04B 15/68

FOREIGN PATENT DOCUMENTS

DE 102017114412 A1 1/2019
EP 0564041 A1 10/1993
WO 2004097092 A1 11/2004
WO WO-2017080931 A1 * 5/2017 ..... D04B 9/10
WO WO-2018197970 A1 * 11/2018 ..... D04B 15/32

OTHER PUBLICATIONS

WO-2018197970 Translation (Year: 2018).*
WO-2017080931—Translation (Year: 2017).*
DE2944300A1 Translation (Year: 2023).*
Search Report dated Aug. 7, 2020 in corresponding International Application No. PCT/IB2020/055122, 5 pages.
Written Opinion dated Aug. 7, 2020 in corresponding International Application No. PCT/IB2020/055122, 9 pages.

* cited by examiner

CIRCULAR KNITTING MACHINE AND A METHOD FOR MOVING THE NEEDLES OF A CIRCULAR KNITTING MACHINE

CROSS-REFERENCE TO RELATED APPLICATIONS

This application is a U.S. National Stage application of PCT/IB2020/055122 filed May 29, 2020, pending, which claims priority to Italian Application No. 102019000008655 filed Jun. 11, 2019, the entire disclosures of which are hereby incorporated by reference.

FIELD OF THE FINDING

The object of the present invention is a circular knitting machine and a method for moving needles of a circular knitting machine. In particular, the present invention relates to members for moving the needles. More particularly, the present invention relates to the structure of the elements which actuate the needles, transforming a relative rotary movement, between a needle-holding member and actuating cams, into axial movements of the needles.

BACKGROUND OF THE FINDING

As is known, the circular knitting machines comprise at least one needle-holding member (needle-holding cylinder and/or plate), on which one or more series of needles are arranged in respective grooves along a circular path (circular needle beds), and devices adapted to control the movement of the needles for the formation of the fabric. The devices for controlling the needles of the needle-holding cylinder comprise actuating cams arranged around the cylinder itself and drive chains configured for operatively connecting the cams to the needles. Each of such drive chains, also defined as "catenaries", comprises multiple flat parts inserted in each groove and below each needle. The drive chains have butts configured for cooperating with the actuating cams. Drive chains are also known which comprise a butt of radially movable type, so as to be able to be selectively engaged with and disengaged from the respective cams.

For example, the public documents WO2004/097092 and WO2004/097094, on behalf of the same Applicant, both illustrate a circular knitting machine provided with a cylinder provided with axial grooves. Each needle of a plurality of needles is housed in one of said axial grooves and drive chains (catenaries), those too placed in the axial grooves, and they interact with the needles during the rotation of the cylinder in order to cause the actuation thereof. The drive chain of each needle comprises: a sub-needle connected to the respective needle and radially oscillatable in the groove in order to selectively engage a butt therewith with paths defined by actuating cams, a punch having an upper portion engageable with a lower end of the sub-needle, it too engageable with respective paths defined by the actuating cams, a selector oscillatable in a radial plane, in order to be engaged in respective paths defined by the actuating cams, and activable by means of selecting devices, in which the selector has an upper portion engageable with a lower portion of the punch. As can be observed, the punch of WO2004/097092 and WO2004/097094 pushes against the sub-needle and also carries out the further function of determining the radial oscillation of the sub-needle and the consequent radial movement of the butt of said sub-needle. The punch acts directly on the sub-needle and is obliged to follow the axial movement of the respective needle. The axial movement of the needle and of the sub-needle is therefore constrained to the axial movement of the punch and of the selector.

The public document EP0962569 illustrates a needle-holding cylinder provided with axial grooves, in which each groove houses a needle, a sub-needle and a selector arranged below the sub-needle and actuated by suitable selecting devices placed around the cylinder. The sub-needle comprises an oscillatable portion, provided with a butt. The oscillatable portion is movable between an inactive position, in which the butt does not interfere with cams arranged around the cylinder, and an active position, in which the butt projects from the respective groove in order to interfere with said cams. The selector is movable so as to cause the shifting of the oscillatable portion from the inactive position to the active position. Also the needles are provided with butts that are engaged in respective cams.

The documents WO2018/197970 and WO2018/197971, on behalf of the same Applicant, illustrate, for each needle, a drive chain which comprises a sub-needle slidably arranged below the respective needle. The sub-needle has a butt radially movable between an operating position, in which it is extracted in order to be engaged with respective first paths defined by first actuating cams and cause the activation of the needle and the processing of the knitted fabric, and a non-operating position, in which it is retracted in order to not be engaged with said first paths. A selector is arranged below the sub-needle and a punch is arranged between the sub-needle and the selector. An activation element is slidably arranged in the respective longitudinal groove between the sub-needle and the selector, it is movable longitudinally with respect to the punch and with respect to the sub-needle and it is operatively engageable with the sub-needle, in order to bring and maintain the butt of the sub-needle in the respective operating position.

SUMMARY

In the scope of the circular knitting machines like those illustrated above, the applicant has encountered the presence of several drawbacks.

First of all, the applicant has observed that the known machines of the above-described type, in particular those illustrated in WO2004/097092 and WO2004/097094 and above all in WO2018/197970 and WO2018/197971, have a high number of components for each drive chain. For example, the machines illustrated in WO2004/097092 and WO2004/097094, in addition to the needle, have for each drive chain three further elements with the respective butts. WO2018/197970 and WO2018/197971, in addition to the needle, has four other elements with the respective butts. It follows that also the cams for the abovementioned butts must be present in a high number and hence also complex. The complexity of the drive chains involves high production, management and maintenance costs which have repercussions over the entire machine.

The applicant has also observed that, in the machines described in WO2004/097092 and WO2004/097094, the radial movement of the butt of the sub-needle, which allows constraining the needle to the cams or releasing the needle from the cams, substantially depends on the axial movements of the selector and/or of the punch and this characteristic limits the movements conferrable to the needles. The applicant has also observed that, in the machines described in WO2018/197970 and WO2018/197971, the radial movement of the butt of the sub-needle is related to the axial travel of the activation element. Also in this case, therefore, the axial movements conferrable to the needles and to the sub-needles are limited by the maximum axial excursion of the activation element.

The applicant has also observed that the known solution of EP0962569, even if the drive chain thereof is provided with a lower number of elements, has a high number of butts (five) and hence high number of actuating cams. In addition, the structure of the drive chains and of the cams of EP0962569 allows a limited number of possible movements of the needles and this limits the production flexibility thereof.

In this situation, one object underlying the present invention, in its various aspects and/or embodiments, is that of proposing a circular knitting machine which, given the same obtainable textile characteristics, or even with more obtainable textile characteristics than the machines of the prior art, is simpler and more rational structurally, less expensive to produce and maintain and also more reliable. For example, the present invention allows simplifying the structure of the cover that the cams carry.

Another object of the present invention is to propose a circular knitting machine and a method for moving needles which allow increasing the plurality of movements that it is possible to confer to the needles so as to obtain a greater production flexibility, or so as to produce different types of fabrics with multiple characteristics that are different from each other.

One particular object of the present invention is to propose a circular knitting machine and a method for moving needles which allow increasing the axial travel of the needles, given the same diameter of the needle-holding cylinder.

Further object of the present invention is to create alternative solutions, with respect to the prior art, in making circular knitting machines, and/or for opening new design fields.

Such objects, and other possible objects, which will be clearer in the course of the following description, are substantially reached by a circular knitting machine, by a method for moving needles and by a drive chain for needles of a circular knitting machine, according to one or more of the enclosed claims, as well as according to the following aspects and/or embodiments, which can be variously combined, possibly also with the aforesaid claims.

In the present description and in the enclosed claims, the terms "upper", "lower", "above" and "below" relate to the positioning of the machine in the normal operation with the central rotation axis of the needle-holding cylinder placed vertically and the needles of the cylinder directed upward. In the present description and in the enclosed claims, the terms "axial", "circumferential", "radial" are referred to the above-mentioned central axis.

In the present description and in the enclosed claims, the terms "non-work", "retained" and "discharged" refer to respective positions and functions of the needles. In particular, in the "non-work" position, the needles are situated in a completely lowered or retracted position in the needle-holding cylinder (bottom non-work) or in a completely raised position (top non-work) and in both cases such to not take up the textile yarn dispensed on the feed that is forming the knitted fabric. In the "retained" position, the needles are situated in a raised position with respect to the "bottom non-work" and such to take up the textile yarn from the yarn feed without discharging the loop of knitted fabric present within the head of the needle. In the "discharged" position, the needles are situated in a raised position with respect to the "retained" (but lower than the "top non-work") and such to take up the textile yarn fed by the yarn feed, discharging the loop of knitted fabric present on the stem thereof.

Aspects of the invention are listed hereinbelow.

In an independent aspect, the invention regards a circular knitting machine, comprising: a needle-holding cylinder having a plurality of longitudinal grooves arranged around a central axis of the needle-holding cylinder; a plurality of needles, each housed in a respective longitudinal groove; actuating cams arranged around the needle-holding cylinder and movable with respect to said needle-holding cylinder around the central axis for causing or allowing the movement of the needles along the longitudinal grooves so as to enable stitch formation by said needles; a drive chain for each needle inserted in the respective longitudinal groove, located below the respective needle and operatively interposed between the respective needle and said actuating cams.

In an independent aspect, the invention also regards a drive chain for each needle of a circular knitting machine, in which the drive chain, once mounted on the circular knitting machine, is inserted in a respective longitudinal groove of a needle-holding cylinder of said machine, in which the drive chain, once mounted on the circular knitting machine, is located below the respective needle and is operatively interposed between the respective needle and actuating cams of said machine.

In one aspect, said drive chain comprises: a sub-needle arranged below the needle and engaged with the needle in order to be axially moved in the respective longitudinal groove together with said needle.

In one aspect, the sub-needle comprises a movable butt radially movable between an operating position, in which it is extracted from the needle-holding cylinder in order to be engaged with respective first paths defined by first actuating cams and cause the activation of the needle, and a non-operating position, in which it is retracted in the needle-holding cylinder in order to not be engaged with said first paths.

In one aspect, said drive chain comprises: a selector partly located below the sub-needle and partly alongside the sub-needle.

In one aspect, the selector is radially coupled or couplable to the sub-needle.

In one aspect, the selector is configured for oscillating between an active position and a rest position so as to control a shifting of the movable butt between the operating position and the non-operating position.

In one aspect, the selector is configured for oscillating between the active position, in which it pushes the movable butt into the operating position, and the rest position, in which it allows the movable butt to return into the non-operating position.

In one aspect, according to one variant, the selector is configured for oscillating between the active position, in which it pushes the movable butt into the non-operating position, and the rest position, in which it allows the movable butt to return into the operating position.

In one aspect, according to a further variant, the selector is configured for oscillating between a first position (active or rest), in which it pushes the movable butt into the operating position or non-operating position, and a second position (rest or active), in which it pushes the movable butt into the non-operating position or operating position.

In one aspect, the selector is axially uncoupled from the sub-needle and from the needle in a manner such that the needle and the sub-needle are never pushed or pulled axially by said selector.

In one aspect, the machine comprises: at least one selecting device acting upon command on the selectors for controlling the passage thereof between the active position and the rest position.

In one aspect, the selecting device causes the passage of the selectors into the active position.

In one aspect, according to one variant, the selecting device causes the passage of the selectors into the rest position.

In one aspect, the drive chain only comprises said sub-needle and said selector or consists of said sub-needle and said selector.

In an independent aspect, the present invention also regards a method for moving needles of a circular knitting machine, in which said machine is optionally made in accordance with the preceding or following aspects.

In one aspect, the method comprises: radially moving a movable butt of a sub-needle, engaged with a respective needle, between an operating position, in which said movable butt is extracted from a needle-holding cylinder in order to be engaged with respective first paths defined by first actuating cams and cause the activation of the needle, and a non-operating position, in which said movable butt is retracted in the needle-holding cylinder in order to not be engaged with said first paths; in which the radial movement of the movable butt of the sub-needle is caused directly by an oscillating movement of a selector partly located below the sub-needle and partly alongside the sub-needle; in which said oscillating movement is controlled by at least one selecting device acting upon command on the selector.

The applicant has verified that the invention allows obtaining the pre-established objects.

The applicant has in particular verified that the invention allows structurally simplifying the members for moving the needles and possibly also the cams and thus the machine in its entirety. In particular, each drive chain or catenary is formed only by two elements: the sub-needle and the selector.

The applicant has also verified that the invention, even with a limited number of elements, is very flexible and allows executing a multiplicity of textile processes.

The applicant has also verified that the oscillation of the selector, which is independent with respect to the translation of the sub-needle and needle, allows deciding where and when to make the butt of the sub-needle radially exit/return independent of the axial position of the selector and of its possible axial travel. This also allows reducing the number of cams which are radially moved, in order to render them active or in order to deactivate them, and thus simplify the cover.

The applicant has also verified that the axial position of the selector can also be maintained fixed or substantially fixed or in any case the possible axial movement of the selector is independent of the axial travel of the sub-needle and needle and considerably reduced with respect to that of the sub-needle and needle.

The solution underlying the present invention, which allows controlling the radial movement of the butt of the sub-needle without substantially moving the selector in axial sense, is particularly effective in the step of forming knitted fabric. By "formation of the knitted fabric" it is intended the processing step in which the needle couples a new yarn and descends so that the old stitch (previously formed)—due in fact to the descent of the needle—passes below the head of the needle, in particular from below the tongue to above the head, causing the completion of the formation of a knitted fabric stitch.

In addition, for example, it is possible to bring the needle to a level higher than non-work in order to carry out the "closed tip pick-up" without substantially axially moving the selector or other accessory elements of the drive chain, like the activator of WO2018/197970 or WO2018/197971 which in the present invention is not present.

The element indicated as selector in the present invention therefore performs the function of selection and also of activation.

Further aspects of the invention are listed hereinbelow.

In one aspect, the circular knitting machine is a machine for socks/stockings, i.e. a machine configured for making fabrics with floated/finished designs and/or jacquard.

In one aspect, the sub-needle and the selector are flat parts. The drive chain is also termed "catenary" and is formed by the abovementioned flat parts slidably inserted in the longitudinal grooves.

In one aspect, the drive chain is configured for uncoupling an axial movement of the needle and/or of the sub-needle from an axial movement of the selector.

In one aspect, the sub-needle and the needle are integrated to form a single body.

In one aspect, the needle and/or the sub-needle comprise a braking system operatively interposed between said needle and/or said sub-needle and the respective groove and configured for maintaining the axial position of the needle and of the sub-needle in the groove if said needle and/or sub-needle are not subjected to other stresses, in particular due to the actuating cams.

In one aspect, the actuating cams comprise said first actuating cams defining respective first paths for the movable butt. The first actuating cams are extended all around the needle-holding cylinder.

In a different aspect, the sub-needle and the needle are distinct elements, coupled or couplable to each other.

In one aspect, an upper end of the sub-needle is engaged with the needle, optionally with a bilateral constraint and/or a hinge.

In one aspect, the sub-needle comprises a first portion axially movable in the respective groove.

In one aspect, the sub-needle comprises a second portion carrying the respective butt, in which the second portion is movable, also radially.

In one aspect, said second portion is elastically movable between a first configuration, corresponding to the operating position of the butt, and a second configuration, corresponding to the non-operating position of the butt.

In one aspect, the selector is operatively engageable with the second portion.

In one aspect, the second portion is hinged to the first portion.

In one aspect, the movable butt is spaced from a center of rotation of the second portion with respect to the first portion.

In one aspect, the movable butt is elastically pushed towards the non-operating position.

In one aspect, the sub-needle comprises a spring operatively interposed between the first portion and the second portion in order to elastically push the second portion and the movable butt towards the non-operating position.

In one aspect, in the non-operating position of said movable butt, said elastic force maintains the movable butt within the respective groove. The applicant has verified that the elastic return ensures the non-operating position, radially retracted safely and effectively.

In one aspect, the selector pushes and maintains the movable butt in the operating position acting against the spring. In other words, the movable butt, when not engaged and not stressed by the selector, remains in the non-operating position due to the elastic return force exerted by the spring and is actively moved into the operating position by means of a thrust exerted radially by said selector.

In one aspect, the sub-needle is axially movable together with the needle between a completely lowered position and a completely raised position, in which the selector is partly located alongside the sub-needle in order to act on the movable butt both when the sub-needle is in the completely lowered position and when the sub-needle is in the completely raised position.

In one aspect, the second portion is movable with an oscillating motion, between the operating position and the non-operating position, upon action of the spring and/or of the selector.

In one aspect, the spring comprises an elastic appendage projectingly extended from the first portion.

In one aspect, the elastic appendage is extended towards the selector.

In one aspect, the elastic appendage has an elongated shape and is extended at least partly alongside the second portion, optionally substantially parallel to an axial direction.

In one aspect, the elastic appendage has a terminal end abutted and/or operatively active against the second portion.

In one aspect, the terminal end is spaced from a center of rotation of the second portion with respect to the first portion.

In one aspect, the sub-needle comprises a projection integral with the first portion and rigidly connected to the first portion, in which the projection is extended substantially parallel to the elastic appendage and on a side of said elastic appendage opposite the second portion. In other words, the elastic appendage lies interposed between the second portion and the projection.

In one aspect, the projection carries out an end stop function for the deformation of the spring and for the oscillation of the first portion.

In one aspect, the projection defines, together with the rest of the first portion, a continuous edge radially directed outward, i.e. towards the actuating cams.

In one aspect, the sub-needle comprises an auxiliary butt.

In one aspect, the auxiliary butt is radially extended from the first portion, in which the auxiliary butt is rigidly connected to the first portion.

In one aspect, the auxiliary butt is arranged higher than the movable butt.

In one aspect, the auxiliary butt of the sub-needle is axially movable together with the first portion and radially fixed.

In one aspect, the actuating cams comprise second actuating cams defining respective second paths for the auxiliary butt. The second actuating cams are extended all around the needle-holding cylinder.

In one aspect, the second actuating cams are arranged higher than the first actuating cams.

In one aspect, the first paths are configured for bringing the auxiliary butt, by means of an axial movement, to be engaged with the second paths.

In one aspect, the needle and the sub-needle are raised or lowered due to the engagement of the butt with the first paths and/or the engagement of the auxiliary butt with the second paths.

In one aspect, the second portion comprises a support portion bearing the movable butt of the sub-needle.

In one aspect, the support portion is spaced from a center of rotation of the second portion with respect to the first portion.

In one aspect, the movable butt and, optionally, the support portion is/are laterally placed with respect to the second portion.

In one aspect, the movable butt and, optionally, the support portion lie below the terminal end of the elastic appendage.

In one aspect, the movable butt and, optionally, the support portion, lies/lie below a distal end of the projection.

In one aspect, an upper surface of the support portion slides and/or abuts against a distal end of the projection at least when the movable butt is in the operating position.

In one aspect, the support portion has a lateral edge from which the movable butt is radially extended.

In one aspect, when the movable butt is in the operating position, the lateral edge of the support portion is aligned with the continuous edge of the first portion.

In one aspect, the second portion has a terminal end which is axially extended beyond the support portion.

In one aspect, the selector has a first part configured for radially pushing and keeping the movable butt in the operating position and a second part opposed to the first part and engageable with said at least one selecting device.

In one aspect, at said at least one selecting device, the selector is made to oscillate between an active position, in which it pushes the movable butt into the operating position, and a rest position, in which it allows the movable butt to return into the non-operating position.

In one aspect, when the selector is correctly installed in the respective groove, the first part of the selector is an upper part and the second part of the selector is a lower part.

In one aspect, the sub-needle is axially movable together with the needle between a completely lowered position and a completely raised position, in which the first part of the selector is placed partly alongside the sub-needle in order to act on the movable butt both when the sub-needle is in the completely lowered position and when the sub-needle is in the completely raised position.

In one aspect, the selector has an elongated shape.

In one aspect, the selector is configured for oscillating around a center placed between the first part and the second part.

In one aspect, the selector is configured for oscillating around a respective axis orthogonal to the central axis and passing through said center.

In one aspect, the first part of the selector is extended at least partly alongside the second portion of the sub-needle.

In one aspect, the first part of the selector is placed in the groove in a radially internal position with respect to the second portion of the sub-needle.

In one aspect, a guide is arranged all around the needle-holding cylinder, in which said needle-holding cylinder is movable with respect to the guide around the central axis.

In one aspect, the guide is integral with the actuating cams, i.e. it does not rotate around the central axis with respect to the actuating cams.

In one aspect, a butt of the selector is placed at a lower end of said selector and is engaged with the guide.

In one aspect, the guide is configured for blocking or releasing the oscillation of the selector as a function of the position of the selector around the central rotation axis.

In one aspect, the guide comprises a track configured for receiving the butt of the selector, in which the track is optionally defined by a circular groove.

In one aspect, once brought into the active position, the selector is blocked in such active position by means of a guide arranged around the needle-holding cylinder in cooperation with a butt of the selector placed at a lower end of said selector.

In one aspect, once brought into the rest position, the selector is blocked in such rest position by means of a guide arranged around the needle-holding cylinder in cooperation with a butt of the selector placed at a lower end of said selector.

In one aspect, the track has first circumferential portions configured for allowing the entrance or the exit of the butt of the selector into or from the track and therefore allowing the oscillation of the selector, optionally upon action of the spring and/or of the selecting devices.

In one aspect, the track has second circumferential portions configured for keeping the butt of the selector outside or inside the track and therefore for preventing the oscillation of the selector.

In one aspect, when the butt of the selector is outside of the track, i.e. it is uncoupled from the track, the selector is in the active position.

In one aspect, when the butt of the selector is within the track, i.e. it is engaged in the track, the selector is in the rest position.

In one aspect, the track has first circumferential portions situated at an upper height and second circumferential portions situated at a lower height.

In one aspect, the track has first circumferential portions having a first axial width and second circumferential portions having a second axial width, in which the first axial width is greater than the second axial width.

In one aspect, the track has connector portions, i.e. ascent or descent ramps, which connect the first circumferential portions with the second circumferential portions.

In one aspect, the butt of the selector has a shape radially diverging outward and at least the second circumferential portions radially diverge outward, in order to retain the butt when it is housed therein.

In one aspect, the first circumferential portions have an axial width greater than a maximum axial size of the butt of the selector.

In one aspect, the guide comprises an abutment ring arranged substantially across from the track, in a radially internal position and spaced from said track.

In one aspect, an upper surface of the abutment ring is situated at a same height as a lower edge of the first sections of the track and at a height higher than a lower edge of the second sections of the track.

In one aspect, when the selector follows the first circumferential portions, the selector is situated in a raised axial position and the butt of the selector is free to radially enter the track or radially exit from the track upon action of the spring and/or of the selecting devices, i.e. the selector can oscillate.

In one aspect, when the selector follows the first circumferential portions, the butt of the selector is radially movable above the abutment ring.

In one aspect, when the selector follows the second circumferential portions, the selector is situated in a lowered axial position and the butt of the selector is radially blocked in the track or the selector is situated in a raised axial position and the butt of the selector is radially blocked outside the track, i.e. in both cases the selector cannot oscillate nor can it be axially moved.

In one aspect, when the selector follows the second circumferential portions and the butt of the selector is radially blocked outside the track, the selector axially rests on the abutment ring and the butt of the selector radially abuts against a surface outside the track and radially facing towards the needle-holding cylinder.

In one aspect, when the selector follows the second circumferential portions and the butt of the selector is radially blocked within the track, the selector radially abuts against the abutment ring.

In one aspect, the selector oscillates upon action of the selecting device and/or of the spring.

In one aspect, the selector comprises at least one tooth radially directed towards the outside and engageable by the selecting device.

In one aspect, said at least one tooth is placed on the second part, optionally between the center and the butt of the selector.

In one aspect, the selector comprises a main flat body.

In one aspect, the selector comprises a pair of springs arranged on opposite sides of the main flat body and abutting against opposite surfaces of the respective groove, in order to facilitate the oscillation of the selector in said groove.

In one aspect, each of the springs comprises a curved plate with convexity directed towards the respective surface of the groove.

In one aspect, the curved plate has only one end joined to the main flat body.

In one aspect, the selector comprises a curved and convex surface arranged on one edge thereof and acting against an abutment element in order to guide the oscillation of said selector.

In one aspect, the curved surface abuts against the abutment element both when said selector is in the raised axial position and in the lowered axial position.

In one aspect, the curved and convex surface is radially directed outward.

In one aspect, the selector comprises a curved and convex edge, radially directed towards the interior, in which said curved and convex edge abuts against a bottom of the respective groove.

In one aspect, the selector comprises an end stop element acting against a stop configured for limiting the axial travel of the selector.

In one aspect, the end stop element abuts against the stop when the selector is in the raised axial position.

In one aspect, the selecting device is an actuator, optionally of magnetic or piezoelectric type.

In one aspect, the actuator is of the type with levers.

In one aspect, the actuator comprises a plurality of levers.

In one aspect, each lever is movable upon command between a first position and a second position, preferably each lever is vertically movable upon command between a raised position and a lowered position.

In one aspect, the actuator comprises a plurality of levers, each oscillatable upon command around a horizontal axis.

In one aspect, the levers of said plurality of levers are arranged consecutively along a common axis, optionally superimposed and aligned along a vertical axis.

In one aspect, the levers are configured for working, i.e. in order to be engaged, with the teeth of the selectors.

In one aspect, each lever is engaged with a tooth of a selector when it is situated in the first position or in the second position and it is not engaged with, i.e. it avoids, the tooth of the selector when it is situated in the second position or in the first position.

In one aspect, the engagement of a lever with a tooth of the selector causes the passage of the selector into the active position.

In one aspect, a plurality of selecting devices are arranged around the needle-holding cylinder and are fixed with respect to the actuating cams.

In one aspect, the oscillating movement of the selector is controlled by a plurality of selecting devices arranged around the needle-holding cylinder.

In one aspect, the plurality of selecting devices comprises a first series of selecting devices which work when the needle-holding cylinder rotates with respect to the actuating cams in a first rotation sense and a second series of selecting devices which work when the needle-holding cylinder rotates with respect to the actuating cams in a second rotation sense opposite the first.

In one aspect, at least one selecting device is placed at each first circumferential section.

In one aspect, a pair formed by a selecting device of the first series and by a selecting device of the second series is situated at at least several of the first circumferential portions.

In one aspect, at said at least one selecting device, i.e. at a first circumferential section, the guide allows the selector to oscillate between the active position and the rest position and, elsewhere, i.e. at a second circumferential section, the guide prevents the selector from oscillating between the active position and the rest position.

In one aspect, at said at least one selecting device, the selector is pushed towards the active position by said at least one selecting device or the selector is pushed towards the rest position by the movable butt in turn elastically pushed towards the respective non-operating position.

In one aspect, each selecting device and each first circumferential section are operatively associated with at least one first path of said first paths, optionally with a plurality of first paths, in order to cause the engagement of the movable butt in said first path or in one of said first paths.

In one aspect, when it is brought into the operating position, the movable butt is engageable in first paths which cause the raising of the needle or in first paths which cause the lowering of the needle.

In one aspect, an axial stroke of the sub-needle and of the needle is released from a possible axial movement of the selector.

In one aspect, a maximum axial stroke of the sub-needle and of the needle, optionally equal to the difference between the top non-work position of the needle and the bottom non-work position of the needle, is comprised between 25 mm and 40 mm.

In one aspect, a maximum axial movement of the selector is comprised between 1 mm and 5 mm.

In one aspect, the circular knitting machine has one or more yarn feeds (feeds).

In one aspect, an electronic control unit is operatively connected to the machine in order to control the movements thereof.

In one aspect, the machine comprises a motor operatively connected to the needle-holding cylinder in order to cause the rotation thereof around the central axis, optionally in a first rotation sense or in a second rotation sense opposite the first.

In one aspect, an electronic control unit is operatively connected to said at least one selecting device in order to actuate the levers and bring them into the first or into the second position.

Further characteristics and advantages will be clearer from the detailed description of a preferred embodiment of a circular textile knitting machine, of a drive chain and of a method for moving needles in accordance with the present invention.

DESCRIPTION OF THE DRAWINGS

Such description will be set forth hereinbelow with reference to the enclosed drawings, provided only as a non-limiting example, in which.

DETAILED DESCRIPTION

Figure 1:
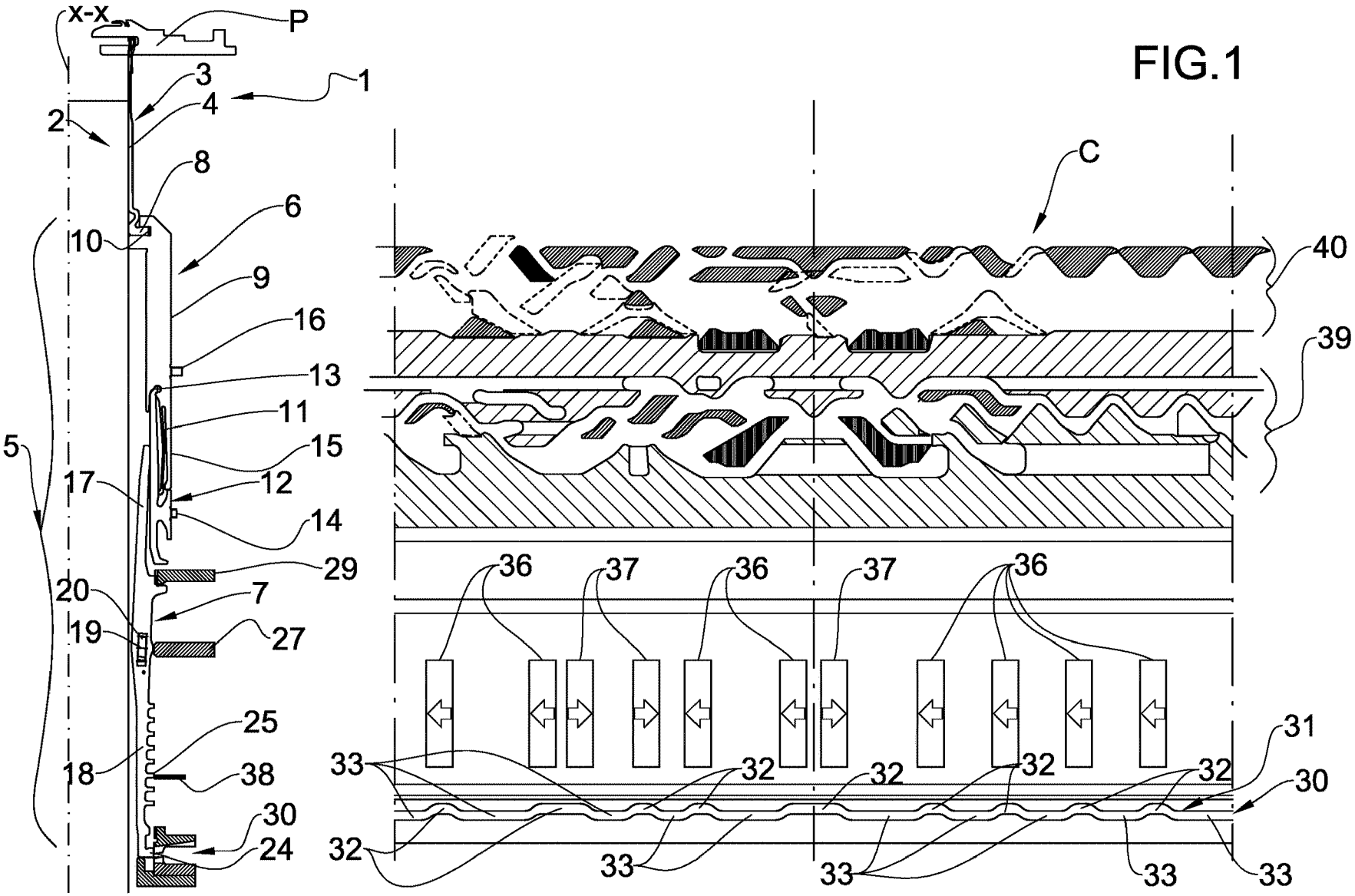
FIG. 1 illustrates an enlarged portion of a needle-holding cylinder of a circular knitting machine according to the present invention, in which the following is visible: a drive chain of a needle combined with actuating cams extended in a flat manner.
Figure 2A:
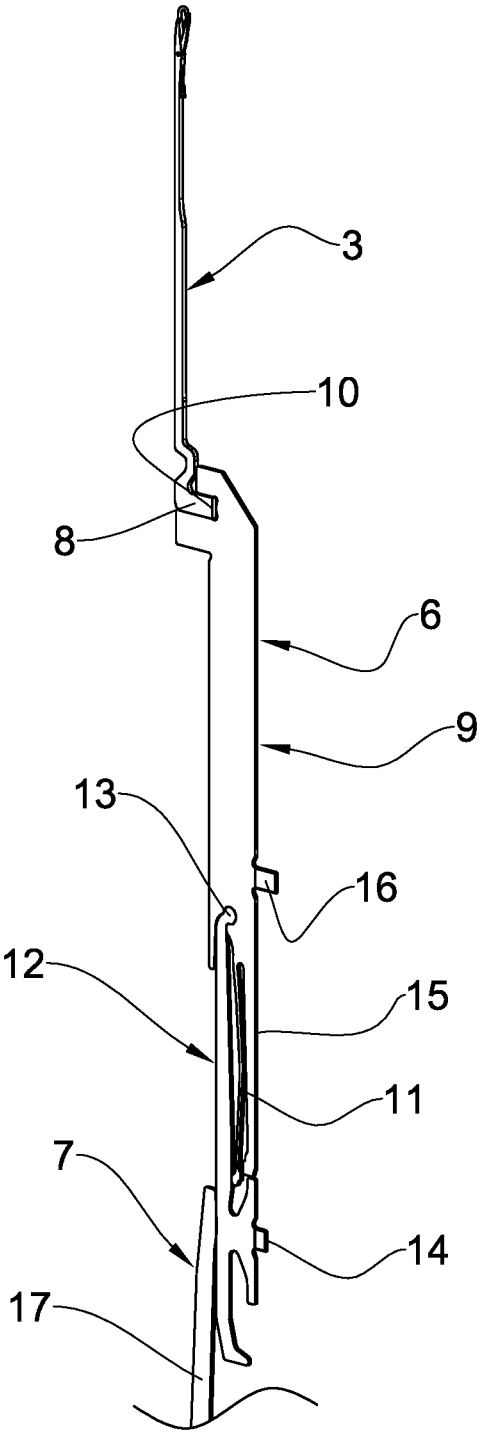
FIGS. 2A and 2B illustrate respective enlarged portions of the drive chain of FIG. 1.
Figure 2B:
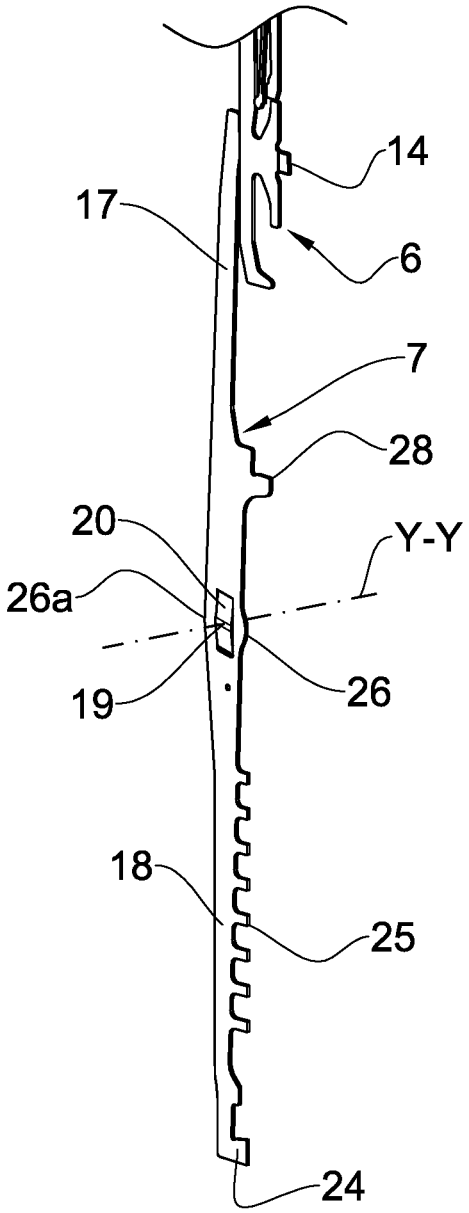

With reference to the abovementioned figures, reference number 1 overall indicates a textile head of a circular textile knitting machine in accordance with the present invention. For example, the circular knitting machine illustrated is a machine configured for making fabrics with floated/finished designs and/or jacquard.

The circular knitting machine comprises a base, not illustrated since per se known, constituting the structure carrying the machine, and the abovementioned textile head 1 mounted on the base.

The textile head 1 is provided with a needle-holding cylinder 2, with a plurality of needles 3 mounted on the needle-holding cylinder 2 and with control devices adapted to selectively actuate the needles 3 in order to allow the production of a fabric.

The needle-holding cylinder 2 is usually mounted vertically on the base with the needles 3 arranged vertically, which project beyond an upper edge of the needle-holding cylinder 2. For example, the needle-holding cylinder 2 has a reference diameter of about 100 mm and a height of about 350 mm.

The needle-holding cylinder 2 has a plurality of longitudinal grooves 4 made on a radially external surface of the cylinder 2. The longitudinal grooves 4 are arranged around a central axis "X-X" (vertical) of the needle-holding cylinder 2 and are extended parallel to said central axis "X-X". In each longitudinal groove 4, a respective needle 3 and a respective drive chain 5 or "catenary" comprising a plurality of flat parts are housed.

FIG. 1 illustrates for the sake of simplicity only one drive chain 5 and only one needle 3 operatively associated or associable with a lowering plate "P" radially movable in respective grooves made in a ring of the machine, per se known and not further described herein.

Actuating cams "C" are arranged as a cover around the needle-holding cylinder 2 and lie facing the externally radial surface of the needle-holding cylinder 2 and therefore the longitudinal grooves 4 and the drive chains 5. Such actuating cams "C" are for example defined by plates and/or grooves arranged or made on a radially internal surface of the cover.

For greater clarity, in FIG. 1 the cover and the actuating cams "C" were represented extended in a plane and side-by-side the drive chain 5, combined with one of the needles 3.

In the illustrated embodiment, the cover of the actuating cams "C" is substantially fixed while the needle-holding cylinder 2 is rotated (with continuous motion or motion alternated in both senses) around the central axis "X-X" in order to generate a relative rotational motion between the drive chains 5 (with the needles 3) and the actuating cams "C". For such purpose, a motor is operatively connected to the needle-holding cylinder 2 and is controlled by a control unit configured for controlling the operation of the machine and its movements. In particular the motor controls the rotation of the needle-holding cylinder 2 in a first rotation sense or in a second rotation sense opposite the first.

As will be described hereinbelow in more detail, the drive chains 5 are operatively couplable to the actuating cams "C" in order to transform the abovementioned relative rotational motion between the needle-holding cylinder 2 and the actuating cams "C" into axial movements of the needles 3 along the longitudinal grooves 4, so as to enable stitch formation by said needles 3 in cooperation with the lowering plates "P". The actuating cams "C" define paths which are extended around the needle-holding cylinder 2 and which are engaged/engageable by butts belonging to the drive chains 5. Therefore, each drive chain 5 is operatively interposed between the respective needle 3 and the actuating cams "C".

Suitable devices, not illustrated, feed the yarns to be knit at one or more points of yarn feed (termed feeds) usually arranged above the needle-holding cylinder 2. The circular knitting machine illustrated in the enclosed figures has only one yarn feed or feed.

Reference will now be made to a single drive chain 5 combined with a respective needle 3 as illustrated in FIGS. 1, 2A, 2B, 3A and 3B. The relative positions between the various elements are described with reference to the drive chain 5 with the respective needle 3 correctly installed in the respective groove 4 of the needle-holding cylinder 2 in vertical position. The needle 3 is arranged at an upper edge of the needle-holding cylinder 2 and the drive chain 5 is extended below the needle 3 up to close to a base of the needle-holding cylinder 2.

As is better visible in FIGS. 1, 2A, 2B, 3A and 3B, the drive chain 5 comprises: a sub-needle 6 arranged immediately below the needle 3 and a selector 7 partly situated below the sub-needle 6 and partly alongside the sub-needle 6. In other words, observing FIG. 1, a portion of the selector 7 is laterally situated with respect to the sub-needle 6 and is positioned between the central axis "X-X" and the sub-needle 6 itself. Since the drive chain 5 is housed in the respective groove 4, said portion remains situated behind the sub-needle 6, i.e. radially more internal in the groove 4 with respect to the sub-needle 6.

The sub-needle 6 is arranged below the needle 3 and engaged with the needle 3 in order to be axially moved in the respective longitudinal groove 4 together with said needle 3. The sub-needle 6 and the selector 7 are metallic flat parts. In one possible embodiment, not illustrated, the sub-needle 6 and the needle 3 can be integrated to form a single body.

In the represented embodiment, the needle 3 has a foot 8 shaped as a kind of hook. When the needle 3 is positioned correctly in the longitudinal groove 4, the foot 8 is radially oriented towards the outside.

The sub-needle 6 has a first portion 9. An upper end of the first portion 9 has a seat 10. The needle 3 is constrained to the sub-needle 6 by means of the insertion of the foot 8 in the seat 10. The constraint between the foot 8 and the seat 10 is of bilateral type, i.e. the needle 3 and the sub-needle 6 are moved axially integral along the longitudinal groove 4. The constraint between the foot 8 and the seat 10 forms a kind of hinge since the needle 3 and the sub-needle 6 are integral with each other in the vertical axial movement but can slightly oscillate with respect to each other at the mutual constraint. Such hinge is translating, along the longitudinal groove 4, based on the axial movement of the needle 3 and of the sub-needle 6 integral with each other. The foot 8 can be easily constrained to or released from the seat 10 in order to allow the easy assembly or disassembly of the two elements.

An elastic appendage 11 is extended projectingly from the first portion 9 and is axially directed downward, i.e. towards the selector 7. The elastic appendage 11 is a kind of arm which can be elastically bent, i.e. work with bending like a spring.

The sub-needle 6 also comprises a second portion 12 hinged to the first portion 9 and also extended from the first portion 9 downward, i.e. towards the selector 7. A hinging pivot or center of rotation 13 of the second portion 12 on the first portion 9 is placed in proximity to a proximal end of the elastic appendage 11 and the elastic appendage 11 is at least partly extended alongside the second portion 12. The elastic appendage 11 is slightly curved and has a terminal or distal end abutted and operatively active against the second portion 12. The terminal end of the elastic appendage 11 is spaced from the center of rotation 13 of the second portion 12.

More in detail, in the represented embodiment, the second portion 12 comprises a rod and a support portion which is extended alongside the rod and carries a movable butt 14. The support portion has a rectilinear lateral edge thereof from which the movable butt 14 is radially extended. The rod has a proximal end hinged to the first portion 9 in the abovementioned center of rotation 13 and a terminal end, opposite the proximal end, which is extended axially beyond the support portion and beyond the movable butt 14.

The support portion and therefore also the movable butt 14 are spaced from the center of rotation 13 of the second portion 12. The support portion and the movable butt 14 lie below the terminal end of the elastic appendage 11 and such terminal end abuts against the rod.

The sub-needle 6 also comprises a projection 15 integral with the first portion 9 and rigidly connected to the first portion 9. The projection 15 has an elongated shape and is extended substantially parallel to the elastic appendage 11 and on one side of said elastic appendage 11 opposite the second portion 12. In other words, the elastic appendage 11 lies interposed between the second portion 12 and the projection 15. The support portion of the second portion 12 remains situated below a distal end of the projection 15.

The sub-needle 6 also comprises an auxiliary butt 16, which is radially extended from the first portion 9 and is rigidly connected to the first portion 9. The auxiliary butt 16 is placed in proximity to the center of rotation 13 and is therefore arranged higher than the movable butt 14 (when the drive chain 5 is correctly installed on the needle-holding cylinder 2).

The first portion 9 of the sub-needle 6 is movable only with an axial translation motion along the respective longitudinal groove 4 together with the respective needle 3. The auxiliary butt 16 of the sub-needle 6 is therefore axially movable together with the first portion 9 and radially fixed.

The second portion 12, in addition to being axially movable with the first portion 9, can oscillate around the center of rotation 13 and with respect to the first portion 9. The rotation or the oscillation of the second portion 12 allows radially moving the movable butt 14 between an operating position (FIG. 3B), in which it is extracted from the needle-holding cylinder 2, and a non-operating position (FIG. 3A), in which it is retracted in the needle-holding cylinder 2.

Figure 3A:
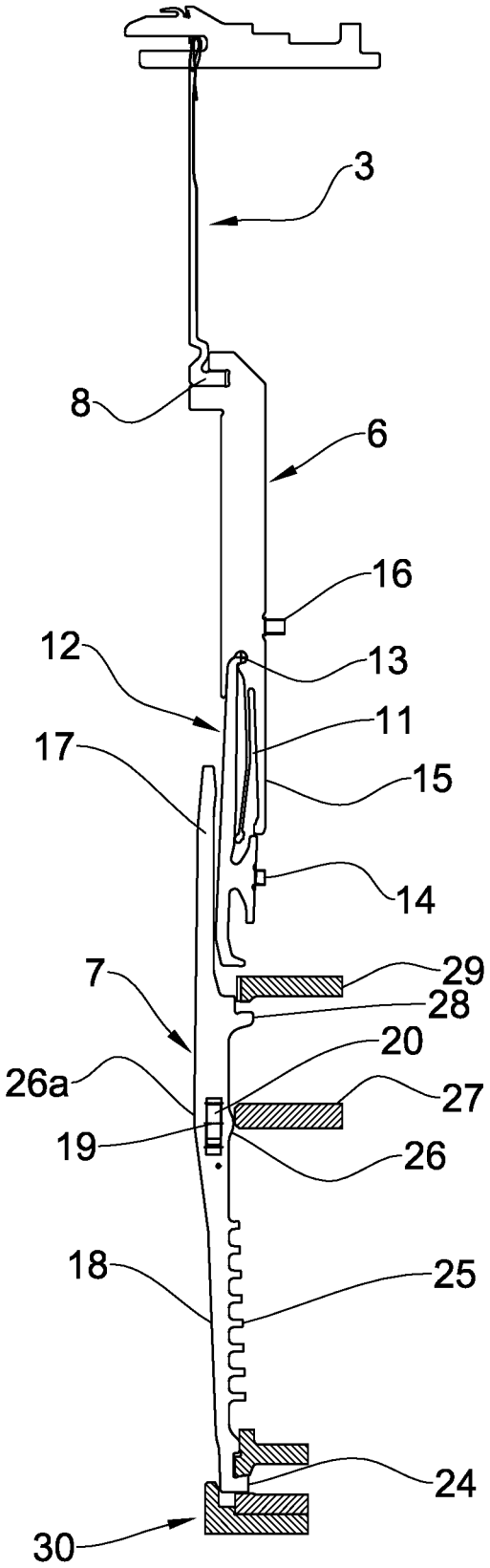
FIGS. 3A and 3B illustrate two possible positions of the drive chain of the preceding figures.

The spring defined by the elastic appendage 11 opposes the rotation of the second portion 12 towards the operating position (FIG. 3B) of the movable butt 14 or, in other words, it tends to push the second portion 12 and the movable butt 14 towards the non-operating position of FIG. 3A. In the non-operating position of said movable butt 14, the elastic force exerted by the elastic appendage 11 maintains the movable butt 14 within the respective groove.

The projection 15 carries out an end stop function for the deformation of the elastic appendage 11 and for the oscillation of the first portion 12. In addition, an upper surface of the support portion slides and/or abuts against a distal end of the projection 15, at least when the movable butt 14 is in the operating position or is close to the operating position. This ensures a certain stiffness of the sub-needle 6. In addition, as is visible in FIG. 3B, the projection 15 defines, together with the rest of the first portion 9, a continuous edge radially directed towards the outside and towards the actuating cams "C". When the movable butt 14 is in the operating position of FIG. 3B, the lateral edge of the support portion is aligned with the continuous edge of the first portion 9.

The needle 3 is provided with a braking system, per se known and hence not described in detail, whose function is that of maintaining in position the abovementioned flat parts (needle 3 and sub-needle 6) within the respective groove 4. The axial position of the assembly formed by the needle 3 and by the sub-needle 6 along the groove 4 is maintained due to the braking system until the sub-needle 6 is stressed by the actuating cams "C". In other words, when the needle 3 and the sub-needle 6 undergo, within the slide groove 4 thereof, a lifting or a lowering due to the interaction with the actuating cams "C", then said needle 3 and sub-needle 6 maintain the axial position thereof due to the braking system present on the needle 3.

Figure 5:
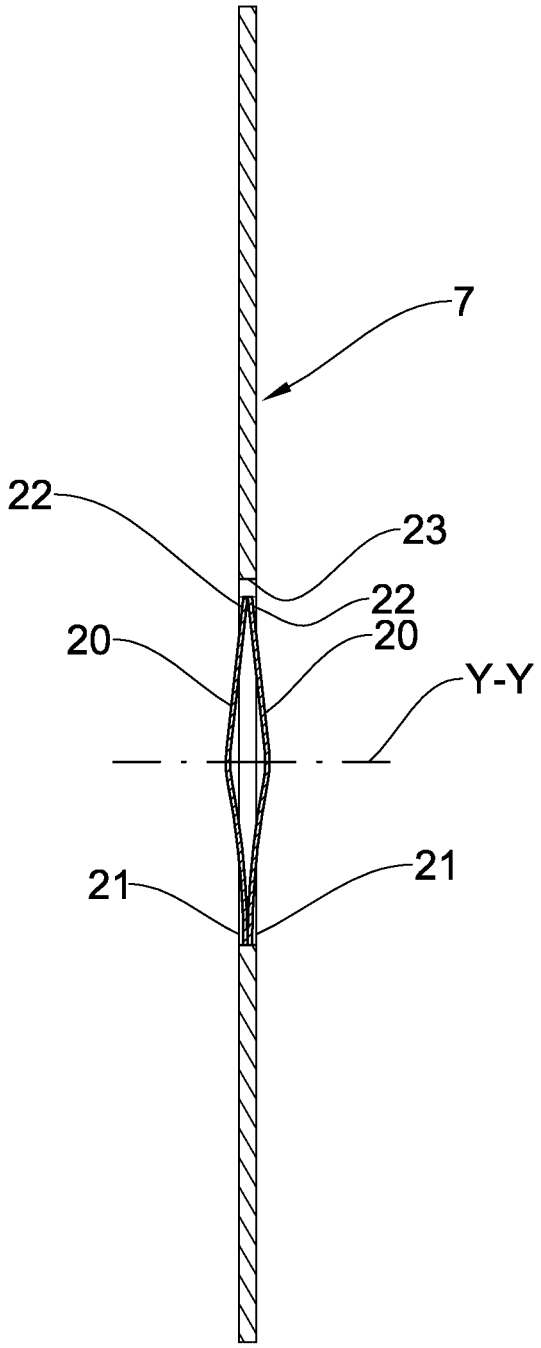
FIG. 5 illustrates a sectional view of an element of the drive chain pursuant to the preceding figures.

The selector 7 has a shape elongated in the sense of the groove 4 and comprises a main flat body. The main flat body has a first part 17 or upper part and a second part 18 or lower part and is configured for oscillating around a center 19 placed between the first part 17 and the second part 18 and around a respective axis "Y-Y" (FIG. 2B) orthogonal to the central axis "X-X" and passing through said center 19. For such purpose, the selector 7 comprises a pair of springs 20 arranged on opposite sides of the main flat body and abutting against opposite lateral surfaces of the respective groove 4, in order to facilitate the oscillation of the selector 7 in said groove 4. As is more visible in FIG. 5, each of the springs 20 comprises a curved plate with convexity directed towards the respective surface of the groove.

The curved plate has a single end 21 joined to the main flat body while the opposite end 22 is free to be moved due to the deformation of the plate operated by the interaction with the lateral surface of the groove 4. The two curved plates laterally project and are partly situated in a through slot 23 made in the main flat body. The two curved plates ensure a limited contact surface of the selector 7 with the opposite lateral surfaces of the respective groove 4 in order to reduce the friction during the oscillation and, simultaneously, also reduce the possible undesired vibrations of the selector 7. In the illustrated embodiment, the springs 20 are symmetric or substantially symmetric so as to maintain the selector centered in the groove 4.

Figure 3B:
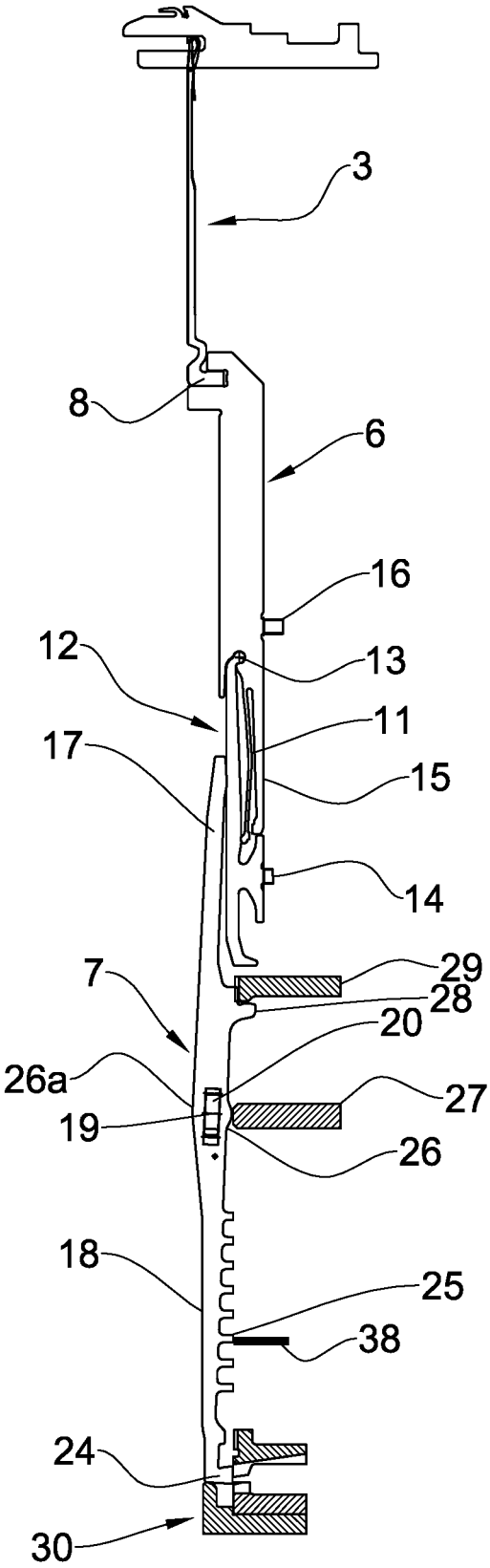

The first part 17 of the selector 7 is extended partly alongside the second portion 12 of the sub-needle 6 and in a radially more internal position with respect to the abovementioned second portion 12, i.e. moved more towards the central axis "X-X". Such first part 17 is configured for being engaged and pushing against the second portion 12. In particular, the selector 7 is configured for oscillating, rotating around the center 19, between an active position, in which its first part 17 pushes the second portion 12 and the movable butt 14 towards the operating position (FIG. 3B), and a rest position, in which it allows the second portion 12 and the movable butt 14 to return into the non-operating position (FIG. 3A). In FIG. 3B, the first part 17 of the selector 7 is radially moved towards the outside and pushes and maintains the movable butt 14 in the operating position acting against the elastic force exerted by the elastic appendage 11. In FIG. 3A, the first part 17 of the selector 7 is radially moved towards the interior and the elastic force from the elastic appendage 11 pushes and maintains the second portion 12 in the non-operating position.

The selector 7 has a butt 24 placed at a lower end of the second part 18 thereof and radially extended towards the outside, like the movable butt 14 and the auxiliary butt 16. The butt 24 of the selector 7 has a wedge shape, i.e. it diverges radially outward.

The selector 7 also comprises at least one tooth 25 situated on the second part 18 between the center 19 and the butt 24 of the selector 7 and also directed radially outward.

The selector 7 is also provided with a curved and convex surface 26 arranged on an edge thereof that is radially outward and acting against an abutment element 27 (which is fixed with respect to the cover with the actuating cams "C") and has the function of better guiding the oscillation of said selector 7.

At said curved and convex surface 26, also an edge **26*a* directed radially towards the interior is curved and convex and abuts against a bottom of the respective groove 4. Also such curved and convex edge 26*a* has the function of guiding the oscillation of said selector 7**.

The selector 7 also comprises an end stop element 28 acting against a stop 29, it too fixed with respect to the cover, in order to limit the axial travel of the selector 7, as will be described hereinbelow.

The cover is provided with a guide 30 which is extended all around the needle-holding cylinder 2, in which needle-holding cylinder 2 is movable with respect to the guide 30. In the illustrated embodiment, the guide 30 is fixed, like the actuating cams "C", while the needle-holding cylinder 2 rotates. The butt 24 of the selector 7 is engaged with the guide 30. The guide 30 is shaped in a manner such to block or release the oscillation of the selector 7 as a function of the angular position of the selector 7 around the rotation axis "X-X".

The guide 30 comprises a track defined by a circular track/groove 31 which opens towards the needle-holding cylinder 2, is extended all around it and is configured for receiving the butt 24 of the selector 7. As is visible in FIG. 1, the circular track/groove 31 has first circumferential portions 32 situated at a higher height and second circumferential portions 33 situated at a lower height. The first circumferential portions 32 are alternated with the second circumferential portions 33 along the circumferential extension of the track (extended on the plane in FIG. 1). Connector portions, i.e. ascending and descending ramps, connect the first circumferential portions 32 with the second circumferential portions 33. In addition, the first circumferential portions 32 have a first width, measured along an axial/vertical direction, which is greater than the second width of the second circumferential portions 33. In addition, the first circumferential portions 32 have an axial width greater than a maximum axial size (measured along a direction parallel to the central axis "X-X") of the butt 24 of the selector 7.

Figure 4A:
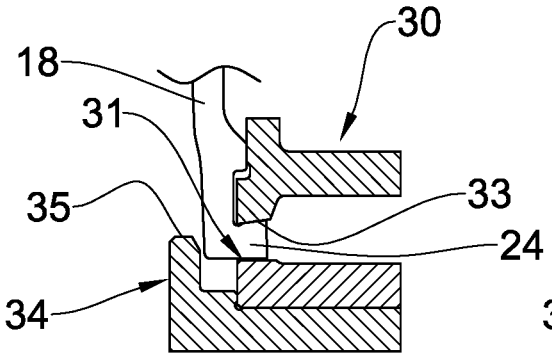
FIGS. 4A, 4B, 4C and 4D illustrate respective enlarged portions in different operating positions of a lower zone of the drive chain of the preceding FIGS. 3A and 3B.
Figure 4B:
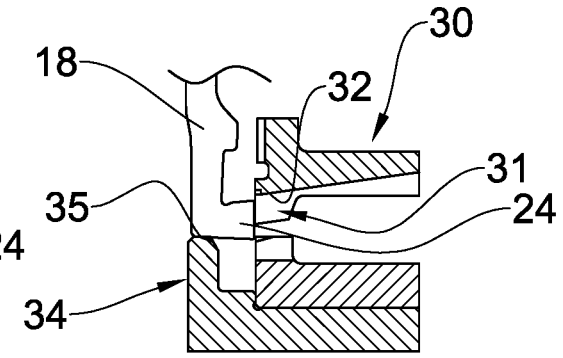
Figure 4C:
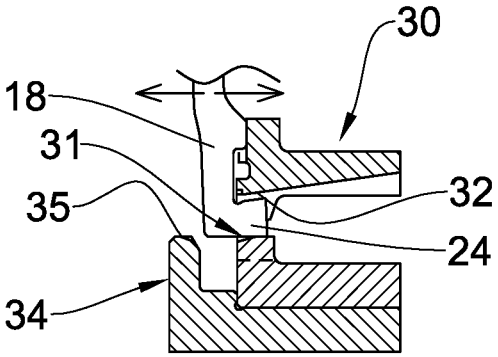
Figure 4D:
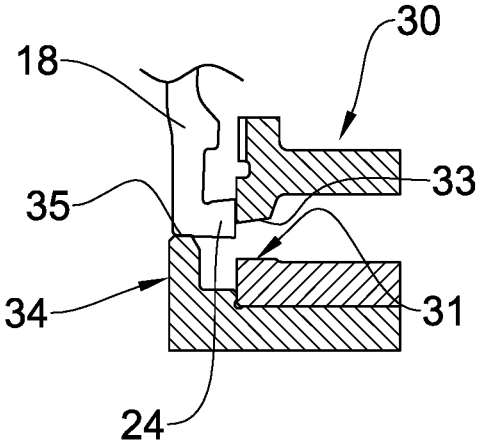

A section of the track at one of the first circumferential portions is illustrated in FIG. 4C. A section of the track at one of the second circumferential portions is illustrated in FIGS. 4A and 4D. FIG. 4B illustrates the track in section at one of the connector portions.

At least at the second circumferential portions 33 (FIG. 4A), the track has, in section, a diverging geometry. In other words, the track is widened, radially proceeding outward, i.e. moving away from the central axis "X-X", and is substantially counter-shaped with respect to the butt 24 of the selector 7.

The guide 30 also comprises an abutment ring 34 arranged substantially across from the track and in a radially internal position and spaced from said track. The abutment ring 34 has an upper surface 35 placed at a constant height. The upper surface 35 of the abutment ring 34 is substantially situated at a same height as a lower edge of the first circumferential portions 32 of the track (FIG. 4C) and at a height higher than the height of a lower edge of the second circumferential portions 33 of the track (FIG. 4A, 4B, 4D).

As will be illustrated hereinbelow, the selector 7 rests on different elements of the guide 30 as a function of its position around the central axis "X-X".

The machine comprises a plurality of selecting devices 36, 37 arranged fixed around the needle-holding cylinder 2 and facing towards the second portions 18 of the selectors 7. The selecting devices 36, 37 are magnetic or piezoelectric actuators with levers situated at the first circumferential portions 33 of the track (FIG. 1).

Figure 6:
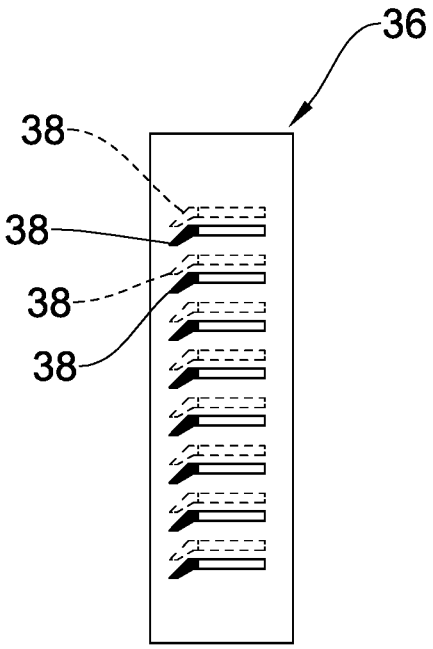
FIGS. 6 and 7 illustrate respective elements of the machine of FIG. 1.
Figure 7:
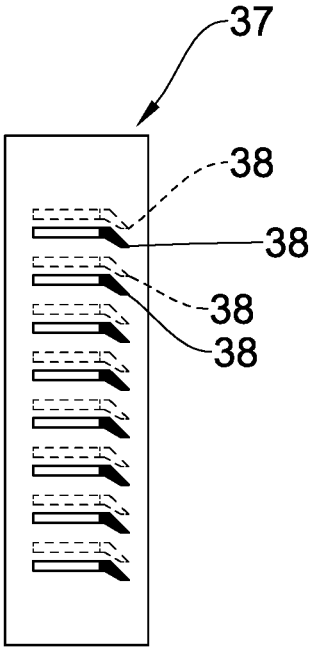

In the embodiment illustrated in FIGS. 6 and 7, the actuator 36, 37 comprises a formation of levers 38 which project from a front face of the actuator 36, 37 and are directed, when the actuator 36, 37 is mounted on the machine 1 in operating position, towards the needle-holding cylinder 2 and towards the teeth 25 of the selectors 7. The formation of levers 38 comprises a plurality of levers 38 superimposed and aligned along a respective common vertical axis. Each lever 38 has an asymmetric shape with respect to a plane of symmetry in which the abovementioned common vertical axis lies. Each of the levers 38 is oscillatable, for example by means of a piezoelectric command managed by the control unit of the machine, around a respective horizontal axis orthogonal to the common axis, between a first raised position (dashed line) and a second lowered position (solid line). By means of the abovementioned oscillation, the lever 38 is lifted and/or lowered and interacts with a respective tooth 25 of the selector 7. In the illustrated embodiment, each lever 38 is engaged with a tooth 25 of a selector 7 when it is situated in the first raised position and it is not engaged with, i.e. it avoids, the tooth 25 of the selector 7 when it is situated in the second lowered position.

The machine is provided with a first series of selecting devices 36 which work when the needle-holding cylinder 2 rotates with respect to the actuating cams "C" in the first rotation sense and with a second series of selecting devices 37 which work when the needle-holding cylinder 2 rotates with respect to the actuating cams "C" in the second rotation sense opposite the first.

As is visible in FIG. 1, the circular track/groove 31 has first circumferential portions 32 with a greater circumferential extension (in the illustrated embodiment there are two such portions) and first circumferential portions 32 with a smaller circumferential extension (in the illustrated embodiment there are seven of such portions). A single selecting device of the first series 36 is combined with six of the first circumferential portions 32 with smaller circumferential extension. A single selecting device of the second series 37 is combined with one of the first circumferential portions 32 with smaller circumferential extension. A pair formed by a selecting device of the first series 36 and by a selecting device of the second series 37 is combined with each of the two first circumferential portions 32 with greater circumferential extension.

The actuating cams "C" comprise first actuating cams 39 defining respective first paths for the movable butt 14 and second actuating cams 40 defining respective second paths for the auxiliary butt 16. The first actuating cams 39 and the second actuating cams 40 are extended all around the needle-holding cylinder 2. The first actuating cams 39 are arranged lower than the second actuating cams 40. In other words, the first actuating cams 39 define a first band which is extended around the needle-holding cylinder 2 and is operatively associated with the movable butt 14. The second actuating cams 40 define a second band which is extended around the needle-holding cylinder 2, is placed higher than the first band and is operatively associated with the auxiliary butt 16.

The first actuating cams 39 delimit/define a plurality of first paths for the movable butt 14. In particular, along the circumferential extension of the first actuating cams 39, such first actuating cams 39 define one or more first paths as a function of the angular position around the central axis "X-X". For example, the first actuating cams 39 define a single first path in a zone of the cover and three first paths placed one on top of the other in a different zone of the cover. Also the second actuating cams 40 delimit/define a plurality of second paths for the auxiliary butt 16. For example, the second actuating cams 40 define a single second path in a zone of the cover and a multiplicity of second paths placed one on top of the other in a different of the cover.

When the movable butt 14 is situated in its non-operating position, it is not engaged with the first actuating cams 39 and does not follow any of the first paths. The auxiliary butt 16 is always in an operating position, i.e. adapted to be intercepted by the second actuating cams 40. Some of said second actuating cams 40 are movable (dashed line in FIG. 1) between a position of interception of the auxiliary butt 16 and a rest position. Others of said second actuating cams 40 are instead fixed. The arrangement of the second actuating cams 40 and the possibility of bringing to rest the movable cams ensures that there are sections in which the auxiliary butt 16 is not intercepted by the second actuating cams.

If the movable butt 14 is in its non-operating position (and hence it is not engaged with the first actuating cams 39) and in those sections in which the auxiliary butt 16 is not intercepted by the second actuating cams 40, the needle 3 and the sub-needle 6 rotate around the central axis "X-X", being maintained at a constant height due to the braking system present on the needle 3. If the movable butt 14 is in its non-operating position (and hence is not engaged with the first actuating cams 39) and in those sections in which the auxiliary butt 16 is intercepted by the second actuating cams 40, the needle 3 and the sub-needle 6 are axially moved by said second cams 40 while they rotate around the central axis "X-X". When the movable butt 14 is in its operating position (and hence is engaged with the first actuating cams 39) it follows one of the first paths and the needle 3 and the sub-needle 6 are axially moved by said first actuating cams 39 while they rotate around the central axis "X-X". The movable butt 14 then causes the activation of the needle 3 when it comes to be engaged with one of the first paths. Each selecting device 36, 37 and each first circumferential section 32 are therefore operatively associated with at least one or more of the abovementioned first paths in order to cause the engagement of the movable butt 14 in said first path or in one of said first paths.

By way of a non-limiting example, several operating steps of the machine will be detailed hereinbelow with reference to the drive chain and to the actuating cams "C" described above.

Figure 8A:
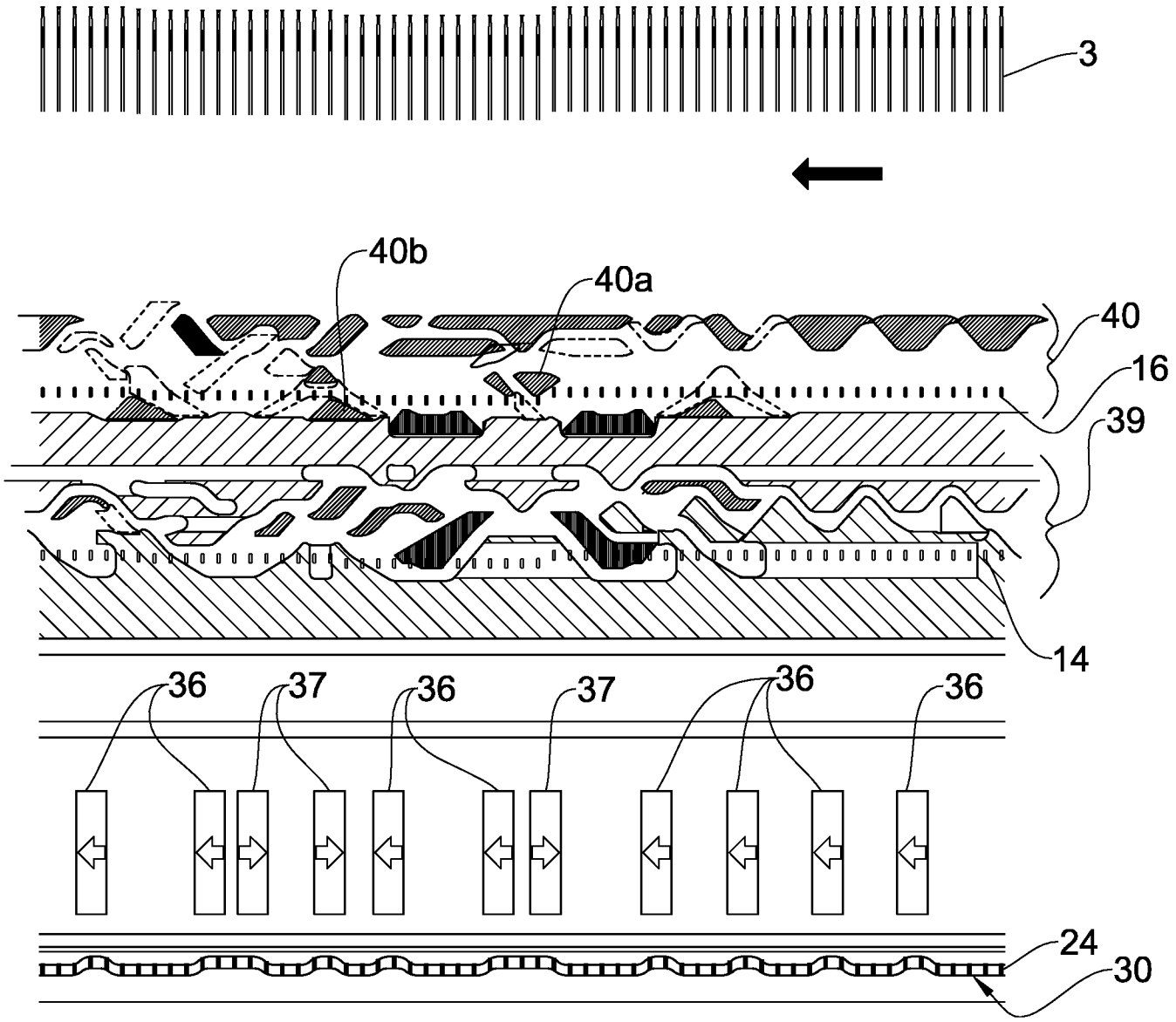
FIGS. 8A-8E illustrate a section of the actuating cams extended in a flat manner with respective paths followed by the drive chain and by the needle.

FIG. 8A illustrates the needles 3 in a "bottom non-work" position and placed at the level of the lowering plates "P". Taking under consideration a single needle 3 with the respective drive chain, this is moved from right to left on the planar extension of the actuating cams "C". Starting from the right end, the selector 7 is situated in its rest position and at one of the second circumferential portions 33. The butt 24 thereof is inserted and retained in the circular track/groove 31 due to the diverging shape and to the abutment ring 34 (as in FIG. 4A). The movable butt 14 is maintained by the elastic appendage 11 in its non-operating position. The auxiliary butt 16 is not intercepted by any second cam 40 so that the needle proceeds at fixed height, i.e. moving horizontally to the left. The butt 24 of the selector 7 continues, sliding in the circular track/groove 31 through the first circumferential portions 32 and the second circumferential portions 33. The selector 7 is slightly raised at the first circumferential portions 32 but its butt 24 continues to remain in the circular track/groove 31, as illustrated in FIG. 4C. The end stop element 28 and the stop 29 ensure that the selector 7 is not raised beyond and the elastic appendage 11 of the sub-needle 6 prevents the oscillation of the selector 7 and the exit of the butt 24 of the selector 7 from the circular track/groove 31. In addition, the curved surface 26 of the selector 7 abuts against the abutment element 27 both when said selector 7 is raised (FIG. 3B) and lowered (FIG. 3A). The first selecting devices 36 are maintained inactive (the second selecting devices 37 do not work in this rotation sense) so that they do not intercept the tooth 25 of the selector 7, which therefore remains in the rest position. The needle 3 and the sub-needle 6 continue horizontally until the auxiliary butt 16 intercepts a cam 40*a* of the second cams 40, which causes a slight lowering thereof and then it continues horizontally until the auxiliary butt 16 intercepts a further cam 40*b* of the second cams 40 which causes a slight lifting thereof and then it continues once again horizontally.

Figure 8B:
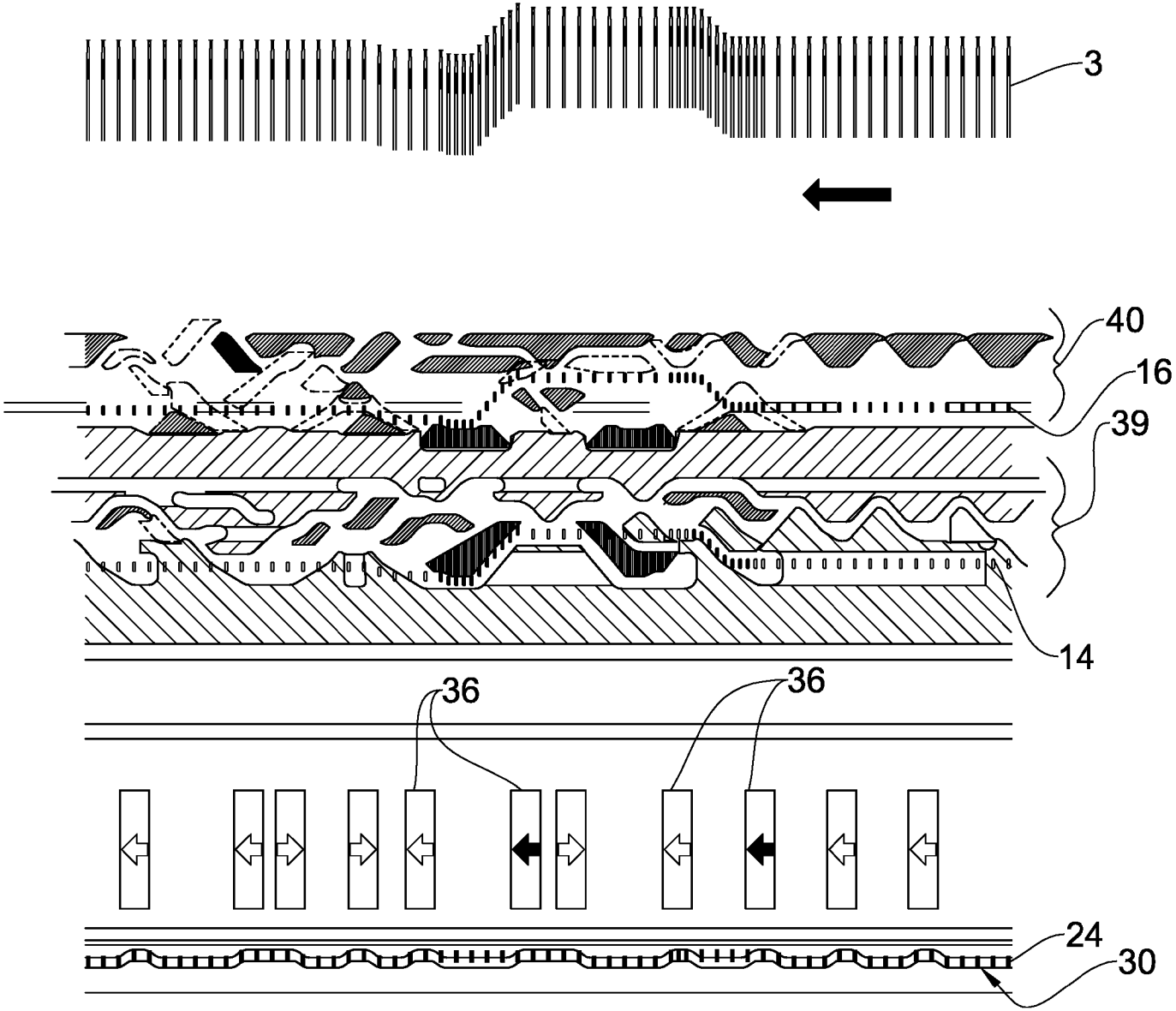

FIG. 8B illustrates the needles 3 selected in a "retained" position with the same rotation sense of FIG. 8A. Starting from the right end, the selector 7 is situated in its rest position and at one of the second circumferential portions 33. The butt 24 thereof is inserted and retained in the circular track/groove 31 (as in FIG. 4A). The movable butt 14 is maintained by the elastic appendage 11 in its non-operating position. The auxiliary butt 16 is not intercepted by any second cam 40 so that the needle 3 proceeds at fixed height (in the bottom non-work position), i.e. moving horizontally to the left, until the third of the first selecting devices 36 (from the right) intercepts with its lever 38 the tooth 25 of the selector 7 while the butt 24 of the selector 7 is situated in a first circumferential section 32 (as in FIGS. 4B and 4C). The lever 38 pushes the tooth 25 and oscillates the selector 7 around the center 19 up to the active position, bringing the butt 24 outside the circular track/groove 31 (as in FIG. 4B). The first part 17 of the selector 7 pushes against the second portion 12 of the sub-needle 6 and brings it, together with the movable butt 14, into the operating position. The movable butt 14 is engaged with one of the first cams 39 which raises it, raising the sub-needle 6 and the needle 3 in the retained position. The selector 7 remains in the operating position up to the subsequent first circumferential section 32, so that along the second circumferential section 33 (the fourth second circumferential section 33 counted starting from the right) the butt 24 cannot return into the track/groove 31 but radially abuts against a surface outside the track/groove 31 and below on the upper surface 35 of the abutment ring 34, as illustrated in the FIG. 4D. The second circumferential portions 33 are therefore configured for keeping the butt 24 of the selector 7 outside (uncoupled) or inside (engaged) the track 31 and for preventing the oscillation of the selector 7.

Once the subsequent first circumferential section 32 has been reached, the respective first selecting device 36 remains inactive, i.e. it does not intercept the tooth 25, so that the selector 7, pushed by the elastic appendage 11, oscillates, the butt 24 is free to return into the track/groove 31 (FIG. 4C) and the movable butt 14 returns to its non-operating position. The needle 3 therefore continues horizontally up to the subsequent first circumferential section 32, at which the respective first selecting device 36 once again brings the movable butt 14 into the operating position. The movable butt 14 intercepts a cam which actively causes the lowering of the needle 3 and of the sub-needle 6.

Figure 8C:
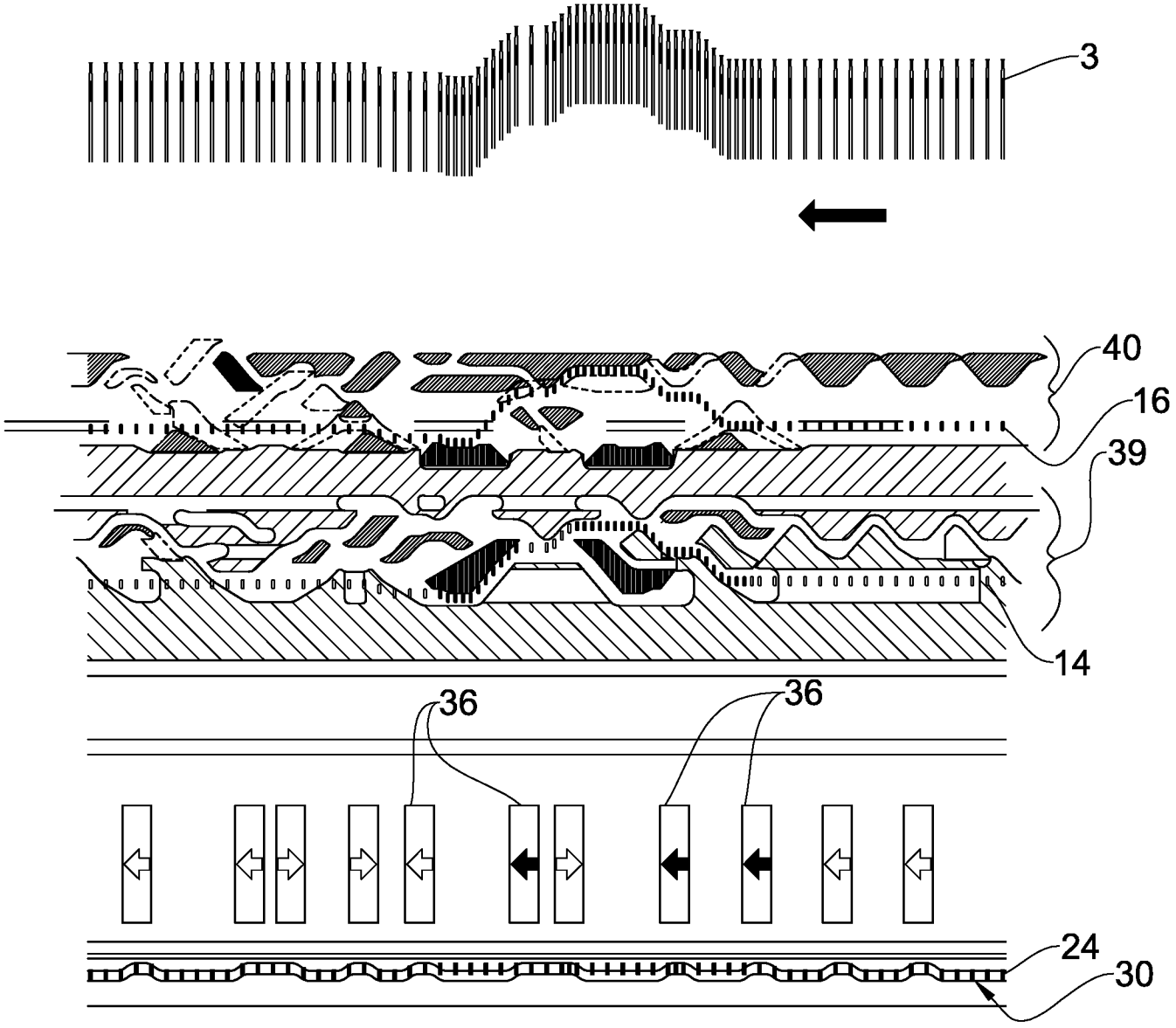

FIG. 8C illustrates the needles 3 selected in a "discharged" position with the same rotation sense of FIG. 8A. The movable butt 14 is activated at the third, fourth and fifth selecting device (from the right) of said first selecting devices 36 in a manner such that the needle 3 is first raised, starting from the bottom non-work position, passing from the retained position and arriving at the "discharged" position, and then lowered.

Figure 8D:
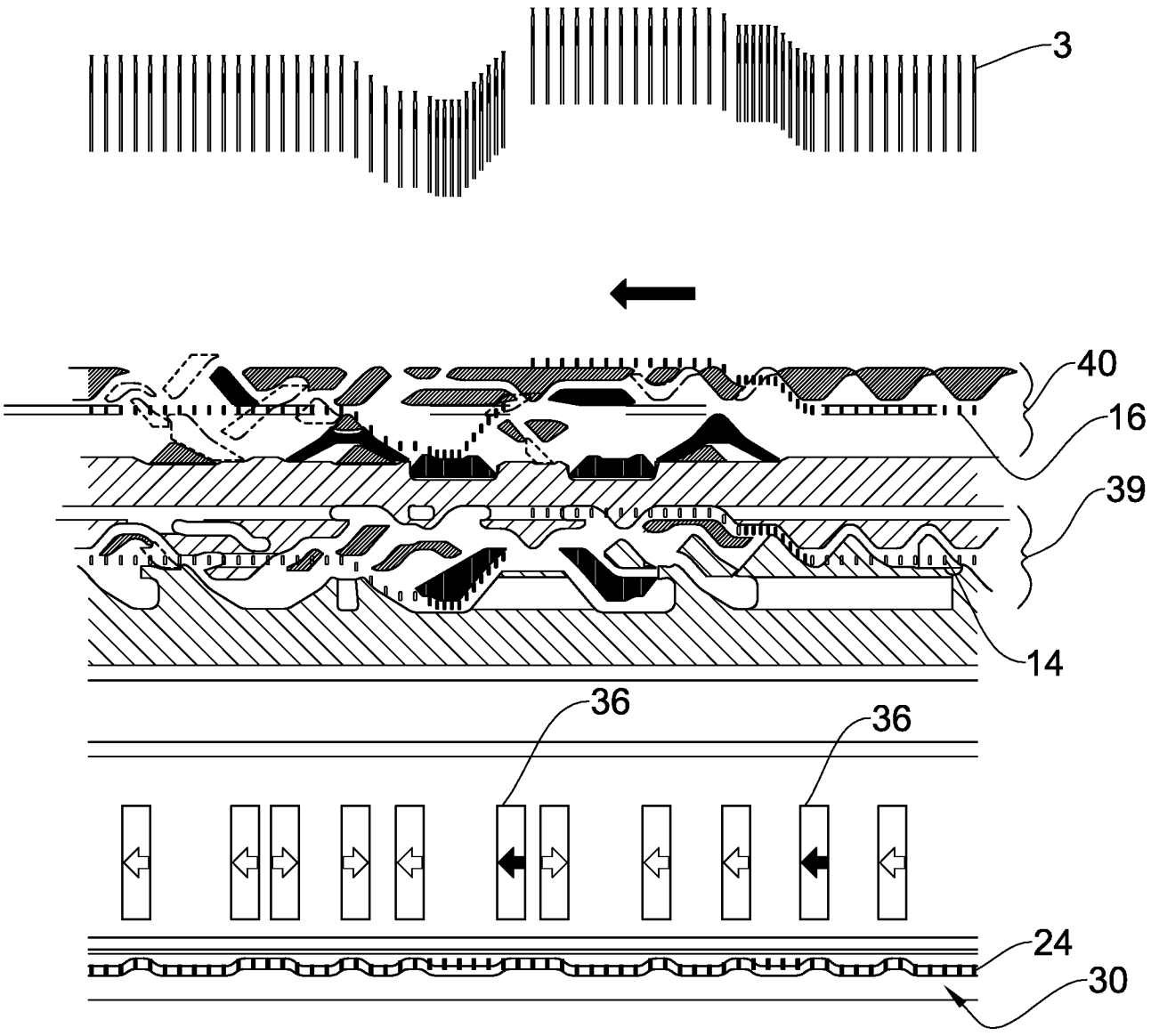

FIG. 8D illustrates a group of needles 3 (placed at the right, observing the figure) selected in a "top non-work" position and another group (at the left) selected while lowering in order to execute the production of knitted fabric. The rotation sense is still that of FIG. 8A. In this step, the needles 3 of the right group start (at the right) from a fixed height higher than that of "bottom non-work". The movable butt 14 is activated at the second selecting device (from the right) of said first selecting devices 36 in a manner such that the abovementioned needles 3 are raised to "top non-work". The needles 3 of the left group start (at the center of FIG. 8D) from a lower work height than the "top non-work". The movable butt 14 is activated at the fifth selecting device (from the right) of said first selecting devices 36 in a manner such that the abovementioned needles 3 are lowered by one of the first cams 39 and specifically by the knitted fabric cam in order to execute the production of the knitted fabric.

Figure 8E:
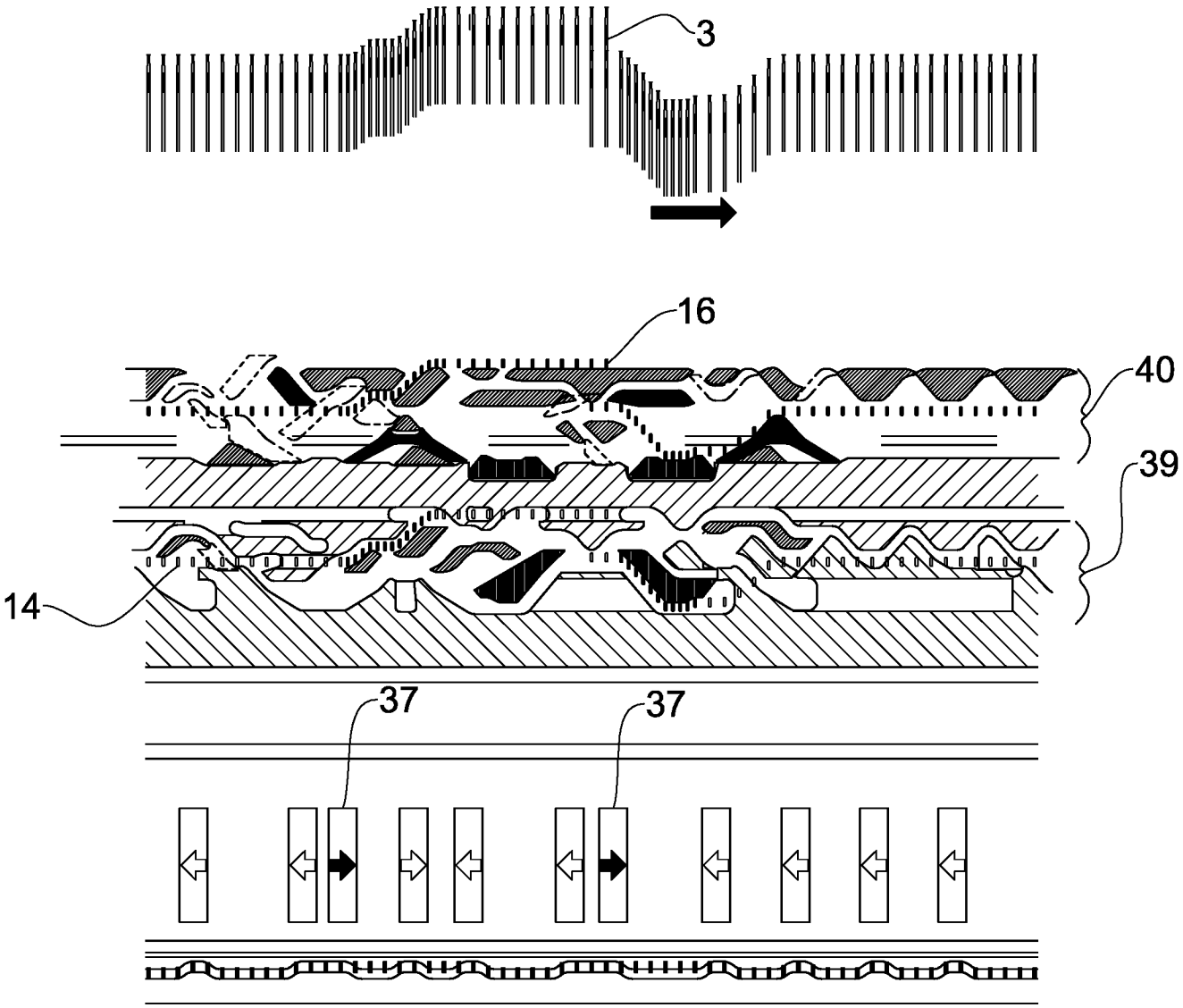

FIG. 8E illustrates a group of needles 3 (placed at the left, observing the figure) selected in a "top non-work" position and another group (at the right) selected while lowering in order to execute the production of knitted fabric. The rotation sense is opposite that of FIG. 8A. In this step, the needles 3 of the left group start (at the left) from a fixed height higher than that of "bottom non-work". The movable butt 14 is activated at the first selecting device (from the left) of said second selectors 37 in a manner such that the abovementioned needles 3 are raised to "top non-work". The needles 3 of the right group start (at the center of FIG. 8E) from a work height that is lower than the "top non-work". The movable butt 14 is activated at the third selecting device (from the left) of said second selecting devices 37 in a manner such that the abovementioned needles 3 are lowered by one of the first cams 39 and specifically by the knitted fabric cam in order to execute the production of the knitted fabric.

FIGS. 8D and 8E illustrate, for example, steps for making a butt of a sock/stocking by means of alternated motion of the needle-holding cylinder 2.

As can be observed from the preceding description, at the selecting devices 36, 37, i.e. at the first circumferential portions 32, the guide 30 allows the selector 7 to oscillate between the active position and the rest position (FIGS. 4B and 4C) and, elsewhere, i.e. at the second circumferential portions, the guide prevents the selector 7 from oscillating between the active position and the rest position (FIG. 4D). In addition, at the selecting devices, the selector 7 is pushed towards the active position by the same selecting devices 36, 37 or the selector 7 is pushed towards the rest position by the second portion 12 bearing the movable butt 14 in turn elastically pushed towards the respective non-operating position by the elastic appendage 11.

The selector 7 is axially uncoupled from the sub-needle 6 and from the needle 3 in a manner such that the needle 3 and the sub-needle 6 are never pushed or pulled axially by said selector 7. The function of the selector 7 is therefore that of activating or deactivating the movable butt 14 but not of axially pushing or pulling the sub-needle 6. Indeed, the drive chain is configured for uncoupling the axial movement of the needle 3 and of the sub-needle 6 from the limited axial movement of the selector 7. The sub-needle 6 is axially movable together with the respective needle 3 between a completely lowered position (bottom non-work) and a completely raised position (top non-work) and the selector 7 remains arranged partly alongside the sub-needle 6, in order to act on the movable butt 14, both when the sub-needle 6 is in the completely lowered position and when the sub-needle 6 is in the completely raised position. For example, a maximum axial stroke of the sub-needle 6 and of the needle 3 is 30 mm while the selector 7 is axially moved 3 mm. The axial extension of the first part 17 or upper part of the selector 7 is such to always be able to act against the second portion 12 of the sub-needle 6, regardless of the axial position of the latter.

The first paths are configured for raising or lowering the movable butt 14 and thus the needle 3 and the sub-needle 6, making them complete the axial stroke necessary or for bringing the auxiliary butt 16 to be engaged with the second paths. Hence, the joint action of the first and second paths raises or lowers the needle 3 and the sub-needle 6.

The above-described allows actuating a method for moving needles of a circular knitting machine which, as emerges from the above description, comprises: radially moving the movable butt 14 of the sub-needle 6, engaged with the respective needle 3, between an operating position, in which said movable butt 14 is extracted from a needle-holding cylinder 2 in order to be engaged with the respective first paths defined by the first actuating cams 39 and cause the activation of the needle 3, and a non-operating position, in which said movable butt 14 is retracted in the needle-holding cylinder 2 in order to not be engaged with said first paths. The radial movement of the movable butt 14 of the sub-needle 6 is caused directly by the oscillating movement of the selector 7 partly located below the sub-needle 6 and partly alongside the sub-needle 6. Said oscillating movement is controlled by at least one of the selecting devices 36, 37 acting upon command on the selector 7.

In the illustrated exemplifying but non-limiting embodiment, the movable butt 14 is pushed into the operating position by the selector 7 and returns into the non-operating position due to the elastic appendage 11. In other embodiments, not illustrated, such assembly can work to the contrary, i.e. the movable butt 14 is pushed into the operating position by the elastic appendage 11 and returns into the non-operating position due to the thrust exerted by the selector 7. In further non-illustrated embodiments, the selector 7 is structured in a manner such to push the movable butt 14 in both directions, i.e. towards the operating position and also towards the non-operating position. In such embodiments, the elastic appendage 11 might not be present. In addition, in non-illustrated embodiments, the selecting device 36, 37 actively causes the passage of the selector 7 into the rest position (instead of into the active position).

The invention attains important advantages.

First of all, the invention allows overcoming the drawbacks of the prior art.

In particular the invention allows:

- making drive chains for circular knitting machines which are structurally simpler and more rational than those of the prior art and hence also less costly and more reliable;
- consequently making circular knitting machines which contain tens or hundreds of needles and drive chains, which are simpler and more rational than those known;
- making circular knitting machines that are structurally simple and simultaneously allow obtaining the same number of movements as the needles of the known machines or even more complex movements;
- making circular knitting machines capable of imparting high axial travels to the needles;
- making circular knitting machines that are flexible and high-performing since they are capable of controlling the needles at a multiplicity of angular positions around the central axis and above all capable of selecting the needles in "non-work", "retained" and "discharged" (three technical paths) and "top non-work" independent of the axial position of the needles themselves.

The invention claimed is:

1. A circular knitting machine, comprising:

a needle-holding cylinder (2) having a plurality of longitudinal grooves (4) arranged around a central axis (X-X) of the needle-holding cylinder (2);

a plurality of needles (3), each being housed in a respective longitudinal groove (4);

actuating cams (C) arranged around the needle-holding cylinder (2) and movable with respect to said needle-holding cylinder (2) around the central axis (X-X) for causing or allowing the movement of the needles (3) along the longitudinal grooves (4) so as to enable stitch formation by said needles (3);

a drive chain (5) for each needle (3) inserted into the respective longitudinal groove (4), located below the respective needle (3) and operatively interposed between the respective needle (3) and said actuating cams (C); wherein said drive chain (5) comprises:

a sub-needle (6) arranged below the needle (3) and engaged with the needle (3) in order to be axially moved in the respective longitudinal groove (4)

together with said needle (3); wherein the sub-needle (6) comprises a movable butt (14) radially movable between an operating position, in which it is extracted from the needle-holding cylinder (2) in order to be engaged with respective first paths defined by first actuating cams (39) and cause the needle (3) to be activated, and a non-operating position, in which it is retracted in the needle-holding cylinder (2) in order to not be engaged with said first paths;

a selector (7) partly located below the sub-needle (6) and partly alongside the sub-needle (6), wherein the selector (7) is configured for oscillating between an active position and a rest position, so as to control a shifting of the movable butt (14) between the operating position and the non-operating position;

at least one selecting device (36, 37) acting upon command on the selectors (7) for controlling the passage thereof between the active position and the rest position;

the circular knitting machine comprising a guide (30) arranged around the needle-holding cylinder (2); wherein said needle-holding cylinder (2) is movable with respect to the guide (30) around the central axis (X-X); wherein a butt (24) of the selector (7) located at a lower end of said selector (7) is engaged with the guide (30); wherein the guide (30) is configured for blocking or releasing the oscillation of the selector (7) according to the position of the selector (7) around the central axis (X-X).

2. The machine according to claim 1, wherein the selector (7) is configured for oscillating between the active position, in which it pushes the movable butt (14) into the operating position, and the rest position, in which it allows the movable butt (14) to return into the non-operating position; wherein said at least one selecting device (36, 37) acts upon command on the selectors (7) so as to cause the passage thereof into the active position.

3. The machine according to claim 1, wherein the selector (7) is axially uncoupled from the sub-needle (6) and from the needle (3) so that the needle (3) and the sub-needle (6) are never pushed or pulled axially by said selector (7).

4. The machine according to claim 1, wherein the drive chain (5) only comprises said sub-needle (6) and said selector (7).

5. The machine according to claim 1, wherein the sub-needle (6) is axially movable together with the needle (3) between a completely lowered position and a completely raised position, wherein the selector (7) is partly placed alongside the sub-needle (6) so as to act on the movable butt (14) both when the sub-needle (6) is in the completely lowered position and when the sub-needle (6) is in the completely raised position.

6. The machine according to claim 1, wherein the sub-needle (6) comprises a first portion (9), which is axially movable in the respective groove (4), and a second portion (12) carrying the respective movable butt (14), wherein the second portion (12) is also radially movable.

7. The machine according to claim 6, wherein the second portion (12) is hinged to the first portion (9).

8. The machine according to claim 7, wherein the sub-needle (6) comprises a spring operatively placed between the first portion (9) and the second portion (12) so as to elastically push the second portion (12) and the movable butt (14) towards the non-operating position; wherein the selector (7) pushes the movable butt (14) to the operating position acting against the spring.

9. The machine according to claim 1, wherein the selector (7) has a first part (17) configured for radially pushing and keeping the movable butt (14) in the operating position, and a second part (18) opposed to the first part (17) and engageable with said at least one selecting device (36, 37).

10. The machine according to claim 9, wherein the selector (7) is configured for oscillating around a center (19) placed between the first part (17) and the second part (18).

11. The machine according to claim 1, wherein the guide (30) comprises a track (31) configured for receiving the butt (24) of the selector (7); wherein the track (31) has first circumferential portions (32) configured for allowing the butt (24) of the selector (7) to enter into or exit from the track (31) and second circumferential portions (33) configured for keeping the butt (24) of the selector (7) outside or inside the track (31).

12. The machine according to claim 11, wherein, when the butt (24) of the selector (7) is outside the track (31), the selector (7) is in the active position and, when the butt (24) of the selector (7) is inside the track (31), the selector (7) is in the rest position.

13. The machine according to claim 1, wherein the selector (7) comprises a main flat body and a pair of springs (20) arranged on opposed sides of the main flat body and abutting against opposed surfaces of the respective groove (4), so as to make it easier for the selector (7) to oscillate in said groove (4).

14. The machine according to claim 13, wherein each of the springs (20) comprises a curved plate whose convexity points towards the respective surface of the groove (4).

15. The machine according to claim 14, wherein the curved plate has only one end (21) joined to the main flat body.

16. The machine according to claim 11, wherein a plurality of selecting devices (36, 37) is arranged around the needle-holding cylinder (2) and is fixed with respect to the actuating cams (C); wherein at least one of the selecting devices (36, 37) is placed at each first circumferential portion (32).

17. A method for moving the needles of a circular knitting machine, wherein said machine is optionally in accordance with claim 1, wherein the method comprises:

radially moving a movable butt (14) of a sub-needle (6), engaged with a respective needle (3), between an operating position, in which said movable butt (14) is extracted from a needle-holding cylinder (2) so as to engage with respective first paths defined by first actuating cams (39) and cause the activation of the needle (3), and a non-operating position, in which said movable butt (14) is retracted in the needle-holding cylinder (2) so as not to engage with said first paths;

wherein the radial movement of the movable butt (14) of the sub-needle (6) is caused directly by an oscillating movement of a selector (7) partly located below the sub-needle (6) and partly alongside the sub-needle (6);

wherein said oscillating movement is controlled by at least one selecting device (36, 37) acting upon command on the selector (7);

wherein, on said at least one select device (36, 37), the selector (7) is oscillated between an active position, in which it pushes the movable butt (14) into the operating position, and a rest position, in which it allows the movable butt (14) to return into the non-operating position; and wherein, once the selector (7) is moved to the active position or to the rest position, it is blocked in such active position or in such rest position by means of a guide (30) arranged around the needle-holding cylinder (2) in cooperation with a butt (24) of the selector (7) placed at a lower end of said selector (7).

18. The method according to claim 17, wherein, on said at least one selecting device (36, 37), the guide (30) allows the selector (7) to oscillate between the active position and the rest position and, in other places, the guide (30) prevents the selector (7) from oscillating between the active position and the rest position.

19. The method according to claim 17, wherein, at said at least one selecting device (36, 37), the selector (7) is pushed towards the active position by said at least one selecting device (36, 37), or wherein the selector (7) is pushed towards the rest position by the movable butt (14), which is in its turn elastically pushed towards the respective non-operating position.

20. The method according to claim 17, wherein the oscillating movement of the selector (7) is controlled by a plurality of selecting devices (36, 37) arranged around the needle-holding cylinder (2).

21. The method according to claim 17, wherein, when the movable butt (14) is brought into the operating position, it can be engaged into first paths causing the needle (3) to be raised, or into first paths causing the needle (3) to be lowered.

22. A drive chain for a needle of a circular knitting machine, wherein the drive chain (5), once mounted to the circular knitting machine, is inserted into a respective longitudinal groove (4) of a needle-holding cylinder (2) of said machine, is located below a respective needle (3) and is operatively interposed between the respective needle (3) and actuating cams (C) of said machine, said drive chain (5) comprising:

a sub-needle (6) arranged below the needle (3) and engaged with the needle (3) so as to be axially moved in the respective longitudinal groove (4) together with said needle (3); wherein the sub-needle (6) comprises a movable butt (14) radially movable between an operating position, in which it is extracted from the needle-holding cylinder (2) so as to engage with respective first paths defined by first actuating cams (39) and cause the needle (3) to be activated, and a non-operating position, in which it is retracted in the needle-holding cylinder (2) so as not to engage with said first paths;

a selector (7) partly located below the sub-needle (6) and partly alongside the sub-needle (6), wherein the selector (7) is configured for oscillating between an active position and a rest position, so as to control a shifting of the movable butt (14) between the operating position and the non-operating position;

wherein the selector (7) comprises a butt (24) located at a lower end of said selector, said butt (24) being engageable with a guide (30); said guide (30) being configured for blocking or releasing the oscillation of the selector (7) according to the position of the selector (7).

* * * * *